United States Patent [19]

Nishikawa et al.

[11] Patent Number: 4,804,617

[45] Date of Patent: Feb. 14, 1989

[54] PROCESSING METHOD FOR SILVER HALIDE COLOR PHOTOSENSITIVE MATERIALS WITH A DESILVERIZATION STEP INCLUDING BOTH A BLEACHING BATH AND A BLEACH FIXING BATH

[75] Inventors: Toshihiro Nishikawa; Akira Abe, both of Kanagawa, Japan

[73] Assignee: Fuji Photo Film Co., Ltd., Minami-ashigara, Japan

[21] Appl. No.: 72,155

[22] Filed: Jul. 10, 1987

Related U.S. Application Data

[63] Continuation-in-part of Ser. No. 870,032, Jun. 3, 1986, abandoned.

[30] Foreign Application Priority Data

Jun. 7, 1985 [JP] Japan ..... 60-123949

[51] Int. Cl.[4] ..... G03C 7/00; G03C 5/44; G03C 7/32; G03C 7/42

[52] U.S. Cl. ..... 430/393; 430/372; 430/386; 430/387; 430/428; 430/430; 430/460; 430/554; 430/555

[58] Field of Search ..... 430/386, 387, 393, 430, 430/428, 460

[56] References Cited

U.S. PATENT DOCUMENTS

| | | | |
|---|---|---|---|
| 4,040,837 | 8/1977 | Sakamoto et al. | 430/466 |
| 4,463,085 | 7/1984 | Mitsui et al. | 430/393 |
| 4,524,129 | 6/1985 | Kishimoto et al. | 430/393 |
| 4,555,479 | 11/1985 | Sakai et al. | 430/393 |
| 4,585,728 | 4/1986 | Furutachi et al. | 430/393 |

FOREIGN PATENT DOCUMENTS

| | | |
|---|---|---|
| 926569 | 5/1963 | United Kingdom . |

*Primary Examiner*—Mukund J. Shah

*Attorney, Agent, or Firm*—Burns, Doane, Swecker & Mathis

[57] ABSTRACT

This invention provides a processing method for exposed silver halide color photosensitive materials, which enables sufficient desilverization to be performed in a short time and highly photographic quality to be obtained. The processing method of this invention comprises the steps of: exposing silver halide color photosensitive material containing 5-pyrazolone-type or pyrazoloazole-type 2-equivalent magenta coupler to light; color developing said photosensitive material; and desilverizing said photosensitive material, wherein said desilverizing step uses a bleaching bath containing ferric complex salt aminopolycarboxylate, and thereafter uses a bleaching-and-fixing bath containing ferric complex salt aminopolycarboxylate.

18 Claims, No Drawings

PROCESSING METHOD FOR SILVER HALIDE COLOR PHOTOSENSITIVE MATERIALS WITH A DESILVERIZATION STEP INCLUDING BOTH A BLEACHING BATH AND A BLEACH FIXING BATH

This is a continuation-in-part of application Ser. No. 870,032, filed June 3, 1986, abandoned.

BACKGROUND OF THE INVENTION (1) Field of the Invention

This invention relates to a processing method for exposed silver halide color photosensitive materials (hereafter) called color photosensitive material), and more particularly to an improved processing method enabling sufficient desilverization to be performed in a short time and high photographic quality to be obtained.

(2) Prior Art

The general basic steps of color photosensitive material processing are the color developing step and the desilverizing step. In the color developing step, the exposed silver halide is reduced by the color developing agent to produce silver, and the oxidized color developing agent reacts on the color coupler to produce a color image. In the next desilverizing step, the silver produced in the color developing step is oxidized by the oxidizing agent (generally called bleaching agent) and the oxidized silver is thereafter dissolved by the complexing agent of silver ions (generally called fixing agent). After the desilverizing step, only the color image remains on the color photosensitive material.

The desilverizing step may be performed by using two baths, a bleaching bath containing the bleaching agent and a fixing bath containing the fixing agent, or by using a single bath, a bleaching-and-fixing bath containing both the bleaching agent and the fixing agent.

In addition to the above basic steps, an actual developing processing includes various auxiliary steps to accomplish several purposes, such as maintaining the photographic and physical qualities of the image and improving the life of the image. For example, the processing may use a hardening bath, a stop bath, an image stabilizing bath, and a washing bath.

The well known bleaching agents are potassium ferricyanite, bichromate, ferric chloride, ferric complex salt aminopolycarboxylate, and persulfate.

Using potassium ferricyanite or the bichromate, however, gives rise to the problem of environmental pollution caused by cyanides or hexavalent chromium. Thus, the use of these agents requires special processing equipment. On the other hand, using the ferric chloride, leads to the problem of the generation of mercurated iron and/or stains in the next washing step. Thus, the use of this agent entails various disadvantages from the point of practical use. Further, persulfate has poor bleaching ability, necessitating a considerably long bleaching time. An improved processing has been suggested for offsetting the disadvantage of persulfate by enhancing its bleaching ability by the use of a bleaching accelerator. Use of the persulfate, however, has another disadvantage in that the persulfate itself is classified as a dangerous material under the Fire Prevention Law, and thus requires various special means for its storage. Therefore, as a practical matter, persulfate is difficult to use.

Ferric complex salt aminopolycarboxylate (especially ferric complex salt ethylenediaminetetraacetate) is the bleaching agent having the most general practical use today since it causes less environmental pollution and fewer storage problems than persulfate. The bleaching ability of ferric complex salt aminopolycarboxylate is, however, not necessarily sufficient. It can be acknowledged that use of ferric complex salt aminopolycarboxylate as the bleaching agent attains the desired objects in the case of performing the bleaching step or the bleaching-and-fixing step for low sensitivity silver halide color photosensitive materials which contain silver chlorobromide emulsion as the main element. However, ferric complex salt aminopolycarboxylate suffers from the disadvantages of poor desilverization ability and long bleaching time when applied to the processing of high sensitivity color photosensitive materials which contain silver chloroiodobromide emulsion or silver bromoiodide emulsion as the main element and also are photochemically sensitized, especially in the case of using the photosensitive materials of high silver emulsion, i.e. photographic color reversal photosensitive materials and photographic color negative photosensitive materials.

For example, when the bleaching step is carried out for photographic color negative photosensitive materials using a bleaching solution of ferric complex salt aminopolycarboxylate, the required bleaching time is at least four minutes and, moreover, complex controls such as pH control of the bleaching solution and aeration are required to maintain the bleaching ability. Even with the sophisticated controls, however, bleaching failure frequently occurs.

In addition, it is necessary that the aforesaid bleaching step be followed by a desilverizing step using a fixing solution and requiring at least three minutes to conduct. Thus, shortening the time required for this step has been strongly desired.

On the other hand German Pat. No. 866,605 discloses a method of speeding up desilverization by using a bleaching-and-fixing solution containing, in a single solution, both the ferric complex salt aminopolycarboxylate and the thiosulfate. In this case, the ferric complex salt aminopolycarboxylate, which has low oxidizing ability (bleaching ability), is mixed with the thiosulfate, which has reducing ability. Thus, the bleaching ability of the former is considerably decreased. Therefore, this bleaching-and-fixing solution is not easily able to desilverize high-sensitivity and high-silver photographic color photosensitive materials, and is not suitable for practical use. Various suggestions have been made regarding improvement of the bleaching-and-fixing solution. These include, for example, a method involving addition of iodides and/or bromides as disclosed in British Pat. No. 926,569 and Japanese Patent Publication No. 53-11854; and a method in which the density of the ferric complex salt aminopolycarboxylate is increased by using triethanolamine as disclosed in Japanese Unexamined Patent Publication No. 48-95834. These methods, however, are insufficient in effect and impractical.

As another method for increasing the bleaching ability of the ferric complex salt aminopolycarboxylate, there has been suggested a method of adding various bleaching accelerators to the bleaching bath and/or the bleaching-and-fixing bath, or the bath preceding these baths.

Among the known bleaching accelerators are included: various mercapto compounds as disclosed in U.S. Pat. No. 3,893,858, British Pat. No. 138,842, and Japanese Unexamined Patent Publication No. 53-141623; compounds containing disulfide bonds as disclosed in Japanese Unexamined Patent Publication No. 53-95630; thiazolidine derivatives as disclosed in Japanese Patent Publication No. 53-9854; isothiourea derivatives as disclosed in Japanese Patent Publication No. 53-94927; thiourea derivatives as disclosed in Japanese Patent Publication No. 49-26586; thioamide compounds as disclosed in Japanese Unexamined Patent Publication No. 49-42349; and dithiocarbamates as disclosed in Japanese Patent Publication No. 55-26506.

Although some of these substances give some measure of bleaching acceleration, the effect is not necessarily sufficient to shorten the required time for processing to the desired degree.

On the other hand, it is well known in the art that the processing method using the bleaching bath and the fixing bath has poor desilverizing ability and does not provide the required rapid processing when the magenta coupler is a 4-equivalent coupler. This disadvantage can be reduced to a certain extent by using a bleaching bath or a bleaching-and-fixing bath to improve the desilverizing ability, but this improvement still does not sufficiently increase the processing speed.

SUMMARY OF THE INVENTION

Under such circumstances, the inventors used, in their investigation, a bleaching bath containing ferric complex salt aminopolycarboxylate, which has a low bleaching ability, and thereafter used a bleaching-and-fixing bath containing both ferric complex salt aminopolycarboxylate and a fixing agent, although they were aware that it was considered especially difficult to apply ferric complex salt aminopolycarboxylate to a photographic color photosensitive material of high sensitivity and high silver because of its low bleaching ability. Contrary to what would ordinarily be expected, however, it was found that the desilverization proceeded in a shorter time than in the conventional method using a bleaching bath and a fixing bath.

It has been noted that in the conventional method using a bleaching bath and a fixing bath, the desilverizing ability is not so different between the 4-equivalent magenta coupler and the 2-equivalent magenta coupler in the case where the photosensitive materials to be processed are color photographic photosensitive materials. In contrast, the inventors have found that in the method using the bleaching bath and the bleaching-and-fixing bath, the desilverizing ability of the 2-equivalent magenta coupler is remarkably better than that of the 4-equivalent magenta coupler. This effect is quite unexpected from the results conventionally obtained with the use of a bleaching bath and a fixing bath.

It is therefore a primary object of the present invention to provide a processing method in which the desilverization of color photosensitive materials (especially those of high sensitivity and high silver) can be sufficiently performed in a short time, and high photographic quality can be obtained.

Another object of the present invention is to provide an easy and practical processing method which minimizes the problem of environmental pollution and gives rise to no problem regarding the storage of processing agents.

These and other object of the present invention will be clear from the following description.

According to the present invention, there is provided a processing method for silver halide color photosensitive materials comprising the steps of: exposing silver halide color photosensitive material containing 5-pyrazolone-type or pyrazoloazole-type 2-equivalent magenta coupler to light; color developing said photosensitive material; and desilverizing said photosensitive material, wherein said desilverizing step uses a bleaching bath containing ferric complex salt aminopolycarboxylate, and thereafter uses a bleaching-and-fixing bath containing ferric complex salt aminopolycarboxylate.

DESCRIPTION OF THE PREFERRED EMBODIMENTS

The 5-pyrazolone 2-equivalent magenta coupler used in the present invention is represented by the following general formula [I]:

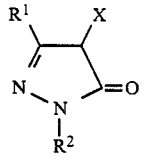

[I]

In the formula, $R^1$ represents a carbonamido group, an anilino group, a sulfonamido group, or a ureido group; $R^2$ represents a phenyl group; X represents a group capable of being eliminated as an anion (hereafter called elimination group) by the coupling reaction with the oxidized product of an aromatic primary amine developing agent.

The general formula [I] will be explained in detail below.

X can be any of the following: a group connecting the activated coupling carbons, through oxygen atoms, nitrogen atoms, sulfur atoms, or carbon atoms, with aliphatic groups, aromatic groups, heterocyclic groups, aliphatic or aromatic or heterocyclic sulfonyl groups, aliphatic or aromatic or heterocyclic carbonyl groups, carbamoyl groups, alkoxycarbonyl groups, or aryloxycarbonyl groups; a halogen atom; an aromatic azo group; or a heterocyclic group. The aliphatic, aromatic and heterocyclic groups contained in X, $R^1$ and $R^2$ may contain further substituents: for example, a halogen atom (e.g. a fluorine atom, a chlorine atom, a bromine atom etc.); an alkyl group (e.g. a methyl group, a t-octyl group, a dodecyl group, a trifluoromethyl group etc.); an alkenyl group (e.g. an allyl group, an octadecenyl group etc.); an aryl group (e.g. a phenyl group, a p-tolyl group, a naphthyl group etc.); an alkoxy group (e.g. a methoxy group, a benzyloxy group, a methoxyethoxy group etc.); an aryloxy group (e.g. a phenoxy group, a 2,4-di-tert-amylphenoxy group, a 3-tert-butyl-4-hydroxyphenoxy group etc.); an acyl group (e.g. an acetyl group, a benzoyl group etc.); a sulfonyl group (e.g. a methanesulfonyl group, a toluenesulfonyl group etc.); a carboxy group; a sulfo group; a cyano group; a hydroxy group; an amino group (e.g. a dimethylamino group etc.); a carbonamido group (e.g. an acetamido group, a trifluoroacetamido group, a tetradecaneamido group, a benzamido group etc.); a sulfonamido group (e.g. a methanesulfonamido group, a hexadecanesulfonamido group, a p-toluenesulfonamido group etc.); an acyloxy group (e.g. an acetoxy group etc.); a sulfonyloxy group (e.g. a methanesulfonyloxy group etc.); an alkoxycarbonyl group (e.g. a dodecyloxycarbonyl group etc.); an aryloxycarbonyl group (e.g. a phenoxycarbonyl group etc.); a carbamoyl group (e.g. a dimethylcarbamoyl group, a tetradecicarbamoyl group etc.); a sulfamoyl group (e.g. a methylsulfamoyl group, a hexadecylsulfamoyl group etc.); an imido group (e.g. a succinimido group, a phthalimido group, an octadecenylsuccinimido group etc.); a heterocyclic group (e.g. a 2-pyridyl group, a 2-furyl group, a 2-thienyl group etc.); an alkylthio group (e.g. a methylthio group etc.); and an arylthio group (e.g. a phenylthio group etc.). Concrete examples of X are: a halogen atom (e.g. a fluorine atom, a chlorine atom, a bromine atom etc.); an alkoxy group (e.g. a benzyloxy group etc.); an aryloxy group (e.g. a 4-chlorophenoxy group, a 4-methoxy group etc.); an acyloxy group (e.g. an acetoxy group, a tetradecanoyloxy group, a benzoyloxy group etc.); an aliphatic or aromatic sulfonyloxy group (e.g. a methanesulfonyloxy group, a toluenesulfonyloxy group etc.); a carboxamido group (e.g. a dichloroacetamido group, a trifluoroacetamido group etc.); an aliphatic or aromatic sulfonamido group (e.g. a methanesulfonamido group, a p-toluenesulfonamido group etc.); an alkoxycarbonyloxy group (e.g. an ethoxycarbonyloxy group, a benzyloxycarbonyloxy group etc.); an aryloxycarbonyloxy group (e.g. a phenoxycarbonyloxy group etc.); an aliphatic, aromatic or heterocyclic thio group (e.g. an ethylthio group, a hexadecylthio group, a 4-dodecylphenylthio group, a pyridylthio group etc.); a ureido group (e.g. a methylureido group, a phenylureido group etc.); a five or six-membered, nitrogen-containing heterocyclic group (e.g. an imidazolyl group, a pyrazolyl group, a triazolyl group, a tetrazolyl group, a 1,2-dihydro-2-oxo-1-pyridyl group etc.); and an imido group (e.g. a succinimido group, a phthalimido group, a hydantoinyl group etc.). Further, the elimination group connected to the ring through a carbon atom may be so-called bis-type coupler derived by condensing the 4-equivalent coupler by aldehydes or ketones.

The pyrazoloazole, 2-equivalent magenta coupler is represented by the following general formula [II]:

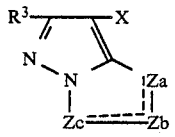

[II]

In the formula, $R^3$ represents a hydrogen atom or a substituent; X represents a group capable of being eliminated as an anion by the coupling reaction with the oxidized product of the aromatic primary amine developing agent. Za, Zb, and Zc each represent methine, substituted methine, and =N— or —N—. One of the Za-Zb bond and the Zb-Zc bond is a double bond and the other is a single bond. The aromatic ring may be condensed at the Zb-Zc bond.

The preferred examples of the pyrazoloazole-type magenta coupler represented by the general formula [2] are represented by the following general formulas (II-1)-(II-7):

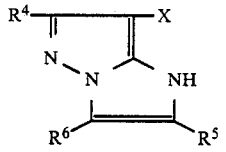

(II-1)

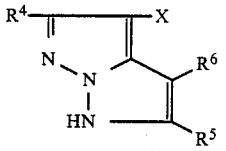

(II-2)

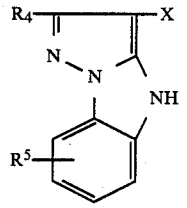

(II-3)

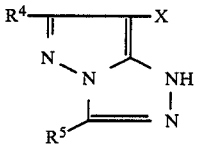

(II-4)

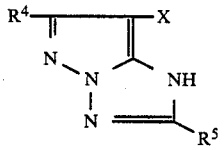

(II-5)

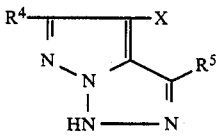

(II-6)

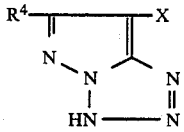

(II-7)

Of the couplers represented by the general formulas (II-1)-(II-7), the preferable couplers for the objects of the present invention are the couplers represented by the general formulas (II-1), (II-4) and (II-5), the most preferable being that represented by the formula (II-5).

In the general formulas (II-1), (II-7), $R^4$, $R^5$, and $R^6$ may be the same or different. $R^4$, $R^5$, and $R^6$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group. It is understood that these groups are to include the groups containing further substituents. X represents a hydrogen atom; a halogen atom; a carboxy group; or a group capable of being coupling eliminated, i.e. the group connected to the carbon atom at the coupling site through an oxygen atom, a nitrogen atom, or a sulfur atom. $R^4$, $R^5$, $R^6$ or X may be divalent groups to form bis-compounds.

Concrete examples of $R^4$, $R^5$ and $R^6$ are: a hydrogen atom; a halogen atom (e.g. a chlorine atom, a bromine atom etc.); an alkyl group (e.g. a methyl group, a propyl group, a t-butyl group, a trifluoromethyl group, a tridodecyl group, a 3-(2,4-di-t-amylphenoxy)propyl group, an allyl group, a 2-dodecyloxyethyl group, a 3-phenoxypropyl group, a 2-hexylsulfonyl-ethyl group, a cyclopentyl group, a benzyl group etc.); an aryl group (e.g. a phenyl group, a 4-t-butylphenyl group, a 2,4-di-t-amylphenyl group, a 4-tetradecaneamidophenyl group etc.); a heterocyclic group (e.g. a 2-furyl group, a 2-thienyl group, a 2-pyrimidinyl group, a 2-benzothiazolyl group etc.); a cyano group; an alkoxy group (e.g. a methoxy group, an ethoxy group, a 2-methoxyethoxy group, a 2-dodecyloxyethoxy group, a 2-methanesulfonylethoxy group etc.); an aryloxy group (e.g. a phenoxy group, a 2-methylphenoxy group, a 4-t-butylphenoxy group etc.); a heterocyclic oxy group (e.g. a 2-benzimidazolyloxy group etc.); an acyloxy group (e.g. an acetoxy group, a hexadecanoyloxy group etc.); a carbamoyloxy group (e.g. a N-phenylcarbamoyloxy group , a N-ethylcarbamoyloxy group etc.); a silyloxy group (e.g. a trimethylsilyloxy group etc.); a sulfonyloxy group (e.g. a dodecylsulfonyloxy group etc.); an acylamino group (e.g. an acetamido group, a benzamido group, a tetradecaneamido group, an α-(2,4-di-t-amylphenoxy)butylamido group, a α-(3-t-butyl-4-hydroxyphenoxy)butylamido group, an α-{4-(4-hydroxyphenylsulfonyl)phenoxy}decaneamido group etc.); an anilino group (e.g. a phenylamino group, a 2-chloroanilino group, a 2-chloro-5-tetradecaneamidoanilino group, a 2-chloro-5-dedecyloxycarbonylanilino group, an N-acetylanilino group, a 2-chloro-5-{α-(3-t-butyl-4-hydroxyphenoxy)-dodecaneamido}anilino group etc.); a ureido group (e.g. a phenylureido group, a methylureido group, an N,N-dibutylureido group etc.); an imido group (e.g. an N-succinimido group, a 3-benzylhydantoinyl group, a 4-(2-ethylhexanoylamino)phthalimido group etc.); a sulfamoylamino group (e.g. an N,N-dipropylsulfamoylamino group, an N-methyl-N-decylsulfamoylamino group etc.); an alkylthio group (e.g. a methylthio group, an octylthio group, a tetradecylthio group, a 2-phenoxyethylthio group, a 3-phenoxypropylthio group, a 3-(4-t-butylphenoxy)propylthio group etc.); an arylthio group (e.g. a phenylthio group, a 2-butoxy-5-t-octylphenylthio group, a 3-pentadecylphenylthio group, a 2-carboxyphenylthio group, a 4-tetradecaneamidophenylthio group etc.); a heterocyclic thio group (e.g. a 2-benzothiazolylthio group etc.); an alkoxycarbonylamino group (e.g. a methoxycarbonylamino group, a tetradecyloxycarbonylamino group etc.); an aryloxycarbonylamino group (e.g. a phenoxycarbonylamino group, a 2,4-di-tert-butylphenoxycarbonylamino group etc.); a sulfonamido group (e.g. a methanesulfonamido group, a hexadencanesulfonamido group, a benzenesulfonamido group, a p-toluenesulfonamido group, an octadecanesulfonamido group, a 2-methyloxy-5-t-butylbenzenesulfonamido group etc.); a carbamoyl group (e.g. an N-ethylcarbamoyl group, an N,N-dibutylcarbamoyl group, an N-(2-dodecyloxyethyl)carbamoyl group, an N-methyl-N-dodecylcarbamoyl group, an N-{3-(2,4-di-tert-amylphenoxy)propyl}carbamoyl group etc.); an acyl group (e.g. an acetyl group, a (2,4-di-tert-amylphenoxy)acetyl group, a benzoyl group etc.); a sulfamoyl group (e.g. an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group etc.); a sulfonyl group (e.g. a methanesulfonyl group, an octanesulfonyl group, a benzenesulfonyl group, a toluenesulfonyl group etc.); a sulfinyl group (e.g. an octanesulfinyl group, a dodecylsulfinyl group, a phenylsulfinyl group etc.); an alkoxycarbonyl group (e.g. a methoxycarbonyl group, a butyloxycarbonyl group, a dodecylcarbonyl group, an octadecylcarbonyl group etc.); and an aryloxycarbonyl group (e.g. a phenyloxycarbonyl group, a 3-pentadecyloxy-carbonyl group etc.).

X has the same meaning as explained with respect to general formula [I].

In the couplers of the general formulas (II-1) and (II-2), $R^5$ and $R^6$ may be connected to each other to form a 5- to 7-membered ring.

Any of $R^1$, $R^2$, or X of the general formula [I], and any of $R^4$, $R^5$, $R^6$, or X of the general formula [II] may form polymers over the bis-compounds, or may form polymers derived from the monomers containing the ethylenically unsaturated groups, or may be copolymers of the coupling monomers and the uncoupling monomers.

If the remaining group of coupler represents a polymer, this polymer is derived from the monomer coupler represented by the general formula (Cp-1) below and contains the repeating units represented by the general formula (Cp-2) below, or is the copolymer of the coupling monomers and one or more kinds of the uncoupling monomers each containing at least one ethylene group which has no coupling capability with the oxidants of the aromatic primary amine developing agent. Two or more kinds of the monomer couplers may be polymerized at the same time.

General Formula (Cp-1)

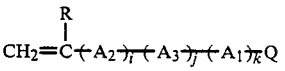

General Formula (Cp-2)

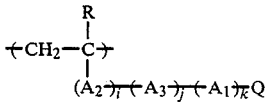

In these formulas, R represents a hydrogen atom, a lower alkyl group containing one to four carbon atoms, or a chlorine atom; $A_1$ represents —$CONR^7$—, —$NR^7CONR^7$—, —$NR^7COO$—, —COO—, —$SO_2$—, —CO—, —$NR^7CO$—, —$SO_2NR^7$—, —$NR^7SO_2$—, —OCO—, —$OCONR^7$—, —$NR^7$—, or —O—; $A_2$ represents —$CONR^7$— or —COO—; $R^7$ represents a hydrogen atom, an aliphatic group, or an aryl group. Where there are two or more $R^7$ in one molecule, they may be the same or different. $A_3$ represents an unsubstituted or substituted alkylene group containing one to ten carbon atoms, an aralkylene group, or an unsubstituted or substituted arylene group: the alkylene group may be a straight chain or a branched chain. (The alkylene group may be, for example, methylene, metylmethylene, dimethylmethylene, dimethylene, trimethylene, tetramethylene, pentamethylene, hexamethylene, or decylmethylene; the aralkylene group may be, for example, benzilidene; and the arylene group may be, for example, phenylene, naphtylene etc.)

Q represents the coupler residual group connected to the general formulas (Cp-1) or (Cp-2) at any of $R^1$, $R^2$, or X of the general formula [1] and at any of $R^4$, $R^5$, $R^6$, or X of the general formulas (II-1)-(II-7).

The symbols i, j, and k represent 0 or 1.

Concrete examples of the substituents of the alkylene group, the aralkylene group, or the arylene group represented by $A_3$ are: an aryl group (e.g. a phenyl group); a nitro group; a hydroxy group; a cyano group; a sulfo group; an alkoxy group (e.g. a methoxy group); an aryloxy group (e.g. a phenoxy group); an acyloxy group (e.g. an acetoxy group); an acylamino group (e.g. an acetylamino group); a sulfonamido group (e.g. a methanesulfonamido group); a sulfamoyl group (e.g. a methylsufamoyl group); a halogen atom (e.g. fluorine, chlorine, bromine etc.); a carboxy group; a carbamoyl group (e.g. a methylcarbamoyl group); an alkoxycarbonyl group (e.g. a methoxycarbonyl group etc.); and sulfonyl group (e.g. a methylsulfonyl group). Where there are two or more of these substituents, they may be the same or different.

Examples of the uncoupling, ethylenically monomer which does not couple with the oxidants of the aromatic primary amine developing agent are: acrylic acid; α-chloroacrylic acid; α-alkylacrylic acid (e.g. methacrylic acid etc.); and ester of amide derived from these acrylic acids (e.g. acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, iso-butyl acrylate, 2-ethylhexcyl acrylate, n-octyl acrylate, lauryl acrylate, methyl methacrylate, ethyl methacrylate, n-butyl methacrylate, and β-hydroxy methacrylate); methylenedibisacrylamide, vinyl ester (e.g. vinyl acetate, vinyl propionate, and vinyl laurate); acrylonitril; methacrylonitril; aromatic vinyl compounds (e.g. styrene and its derivatives, vinyltoluene, divinylbenzene, vinylacetophenone, and sulfostyrene); itaconic acid; citraconic acid; crotonic acid; vinylidene chloride; vinyl alkyl ether (e.g. vinyl ethyl ether); maleic acid; maleic anhydride; maleate; N-vinyl-2-pyrolidone; N-vinylpyridine; and 2- and 4-vinylpyridine. Two or more kinds of uncoupling ethylenically unsaturated monomers may be used in combination, for example, n-butyl acrylate and methyl acrylate; sytrene and methacrylic acid; methacrylic acid and acrylamide; metyl acrylate and diacetoneacrylamide, and so on.

The effects of the present invention are more remarkable in case of using the polymer coupler containing the units of the general formula (Cp-2).

The synthesizing methods for the couplers having the general formula [I] and the polymer couplers having their coupler residual groups are disclosed, for example in: Japanese Unexamined Patent Publication Nos. 49-111631, 54-48540, 55-62454, 55-118034, 56-38043, 56-38043, 56-80045, 56-126833, 57-4044, 57-35858, 57-94752, 58-17440, 58-50537, 58-85432, 58-117546, 58-126530, 58-145944, 58-205151, 54-170, 54-10491, 54-21258, 53-46452, 53-46453, 57-36577, 60-2953, 60-23855 and 60-170854; and U.S. Pat. Nos. 3,227,554, 3,432,521, 4,310,618, 4,351,897, 4,264,723, 4,310,619, 4,301,235, 4,308,343, and 4,367,282.

Concrete examples and the synthesizing methods for the pyrazoloazole-type magenta coupler used in the present invention and represented by the general formula [II] are disclosed, for example, in: Japanese Unexamined Patent Publication Nos. 59-162548, 59-171956, 60-43659, 60-172982 and 60-33552; and U.S. Pat. No. 3,061,432.

Typical magenta couplers according to the present invention and their vinyl monomers will be shown below, but it is to be understood that the present invention is not limited to these specific examples.

The following are preferred examples of the 5-pyrazolone-type, 2-equivalent magenta coupler represented by the general formula [I].

(M-1)

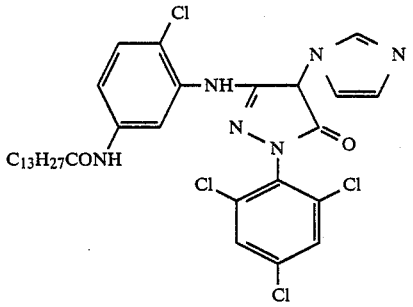

(M-2)

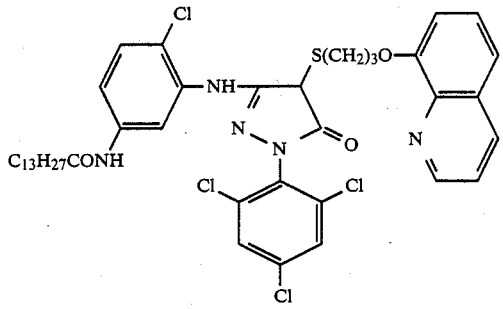

(M-3)

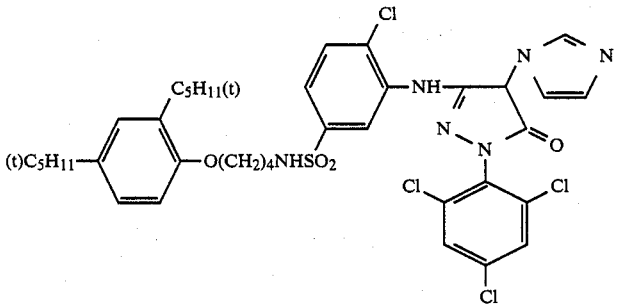

-continued
(M-4)
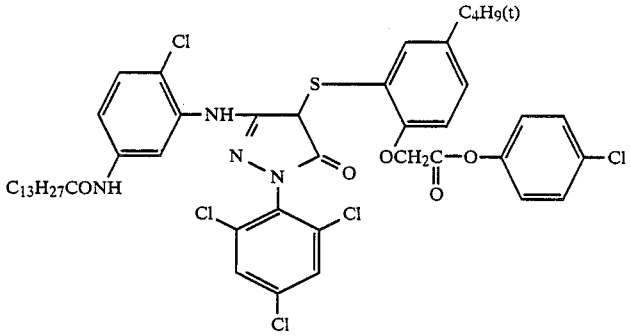
(M-5)
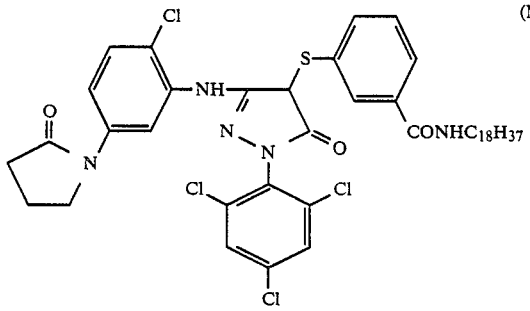
(M-6)
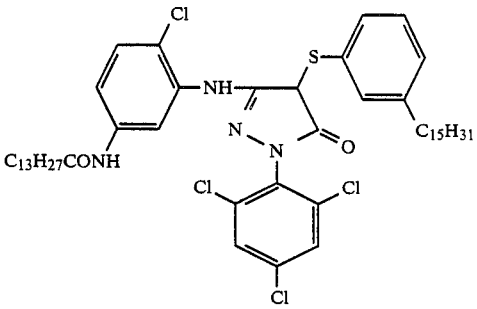
(M-7)
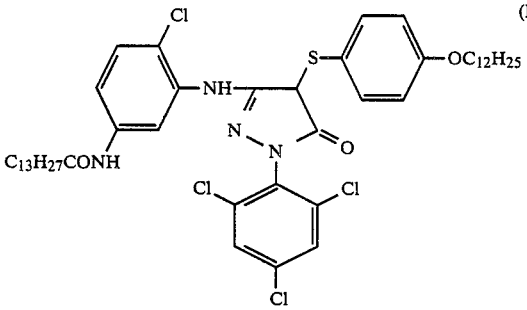
(M-8)
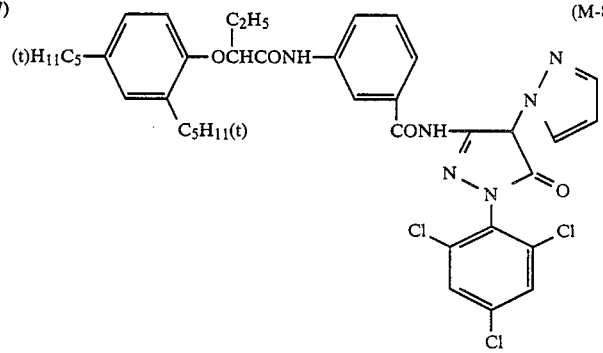
(M-9)
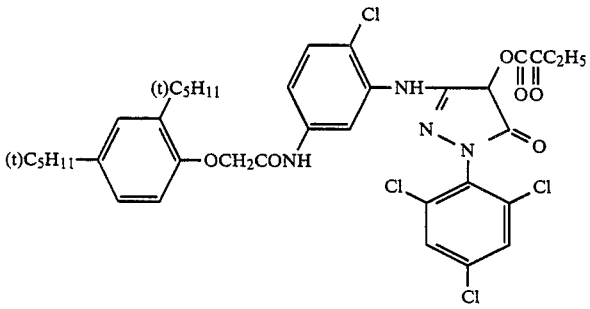
(M-10)
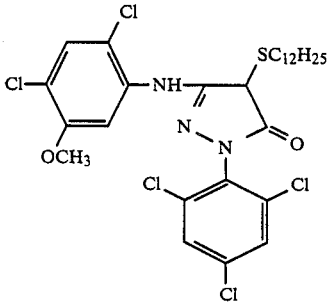
(M-11)
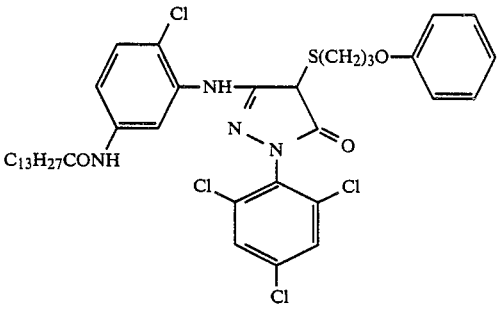

-continued
(M-12)
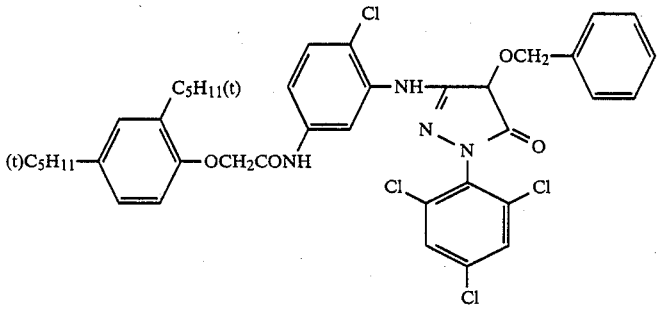
(M-13)
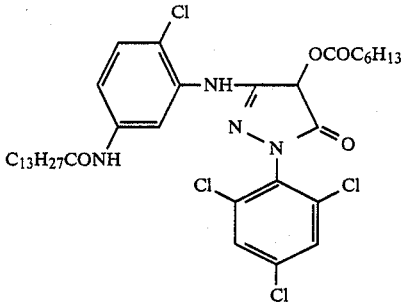
(M-14)
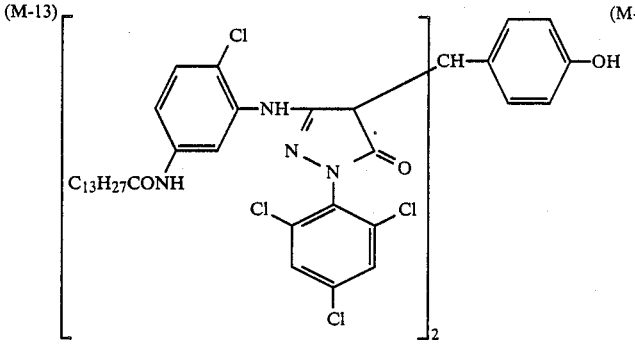
(M-15)
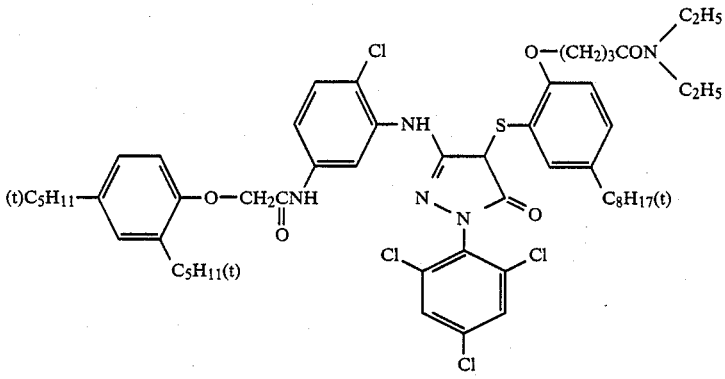
(M-16)
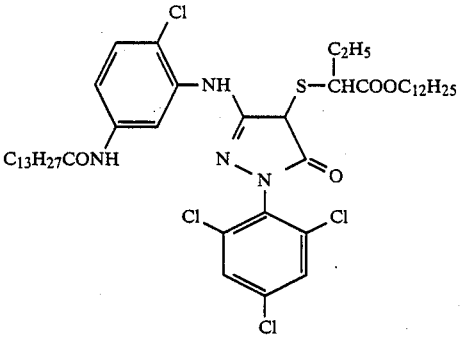

-continued
(M-17)
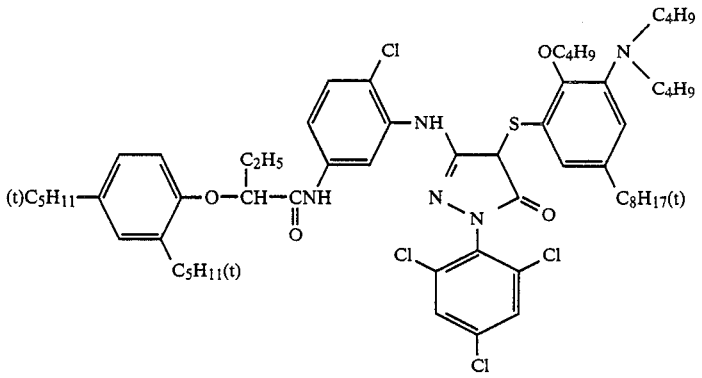
(M-18)
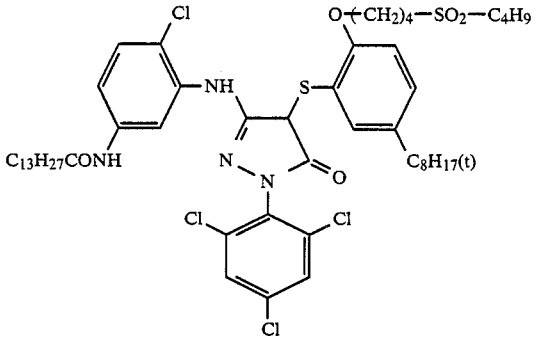
(M-19)
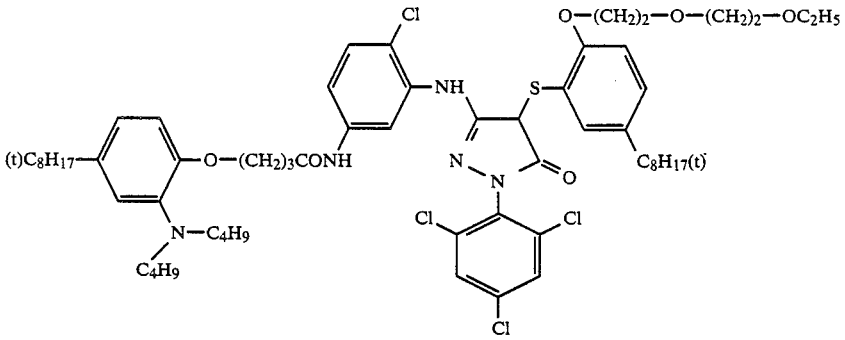
(M-20)
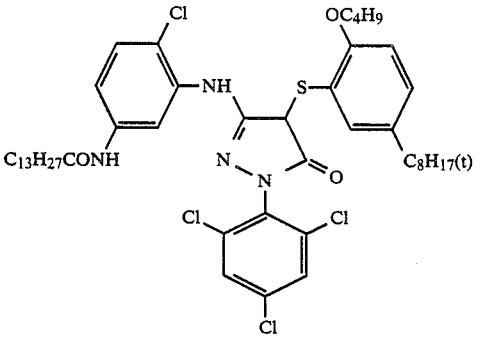
(M-21)
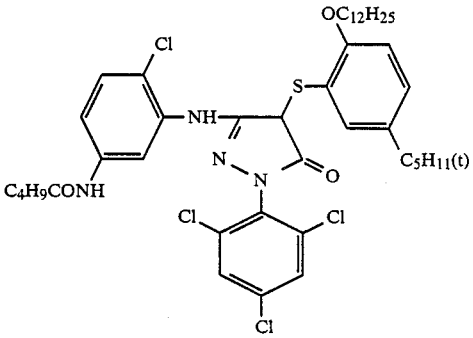

-continued
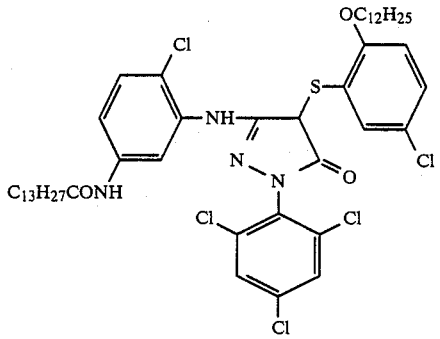
(M-22)
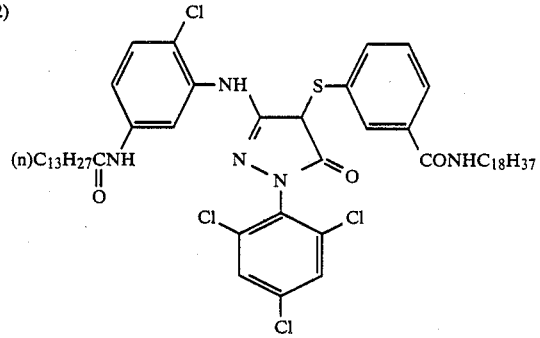
(M-23)
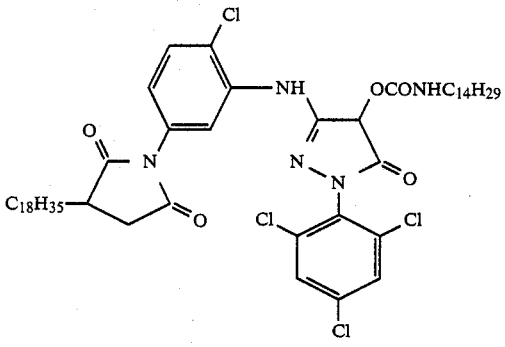
(M-24)
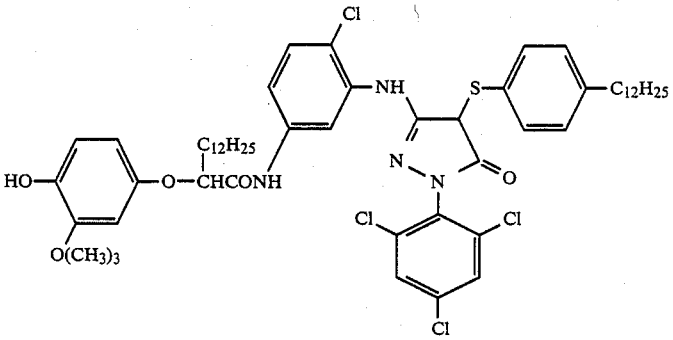
(M-25)
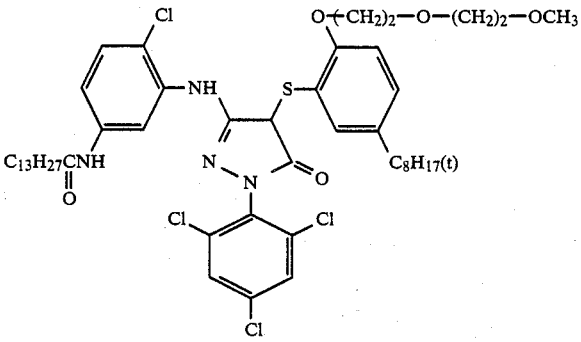
(M-26)

-continued
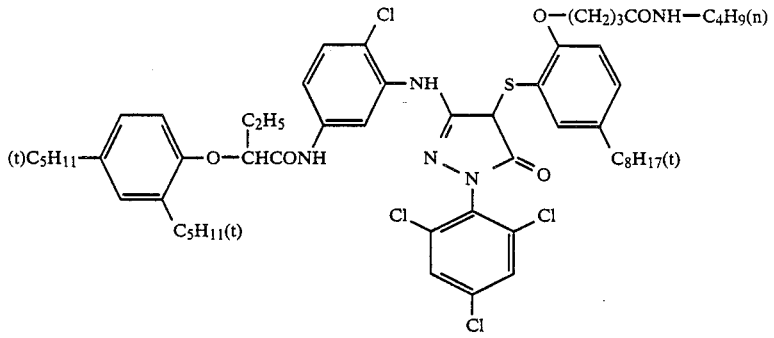
(M-27)
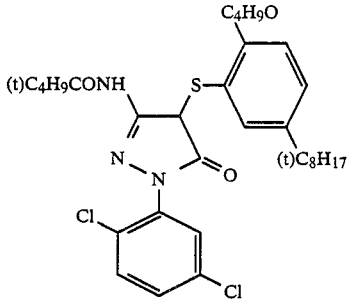
(M-28)
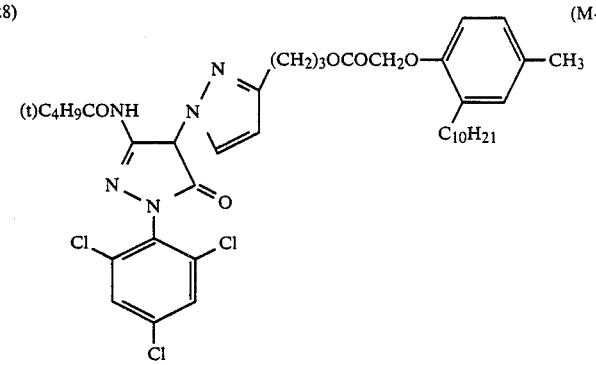
(M-29)
The following are preferred examples of the pyrazoloazole-type, 2-equivalent magenta coupler represented by the general formula [II].
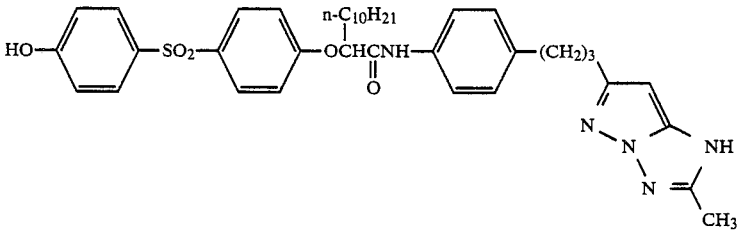
(M-30)
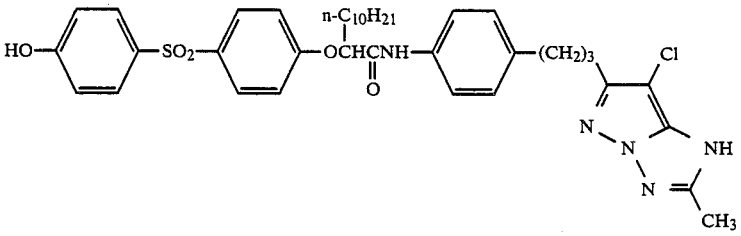
(M-31)
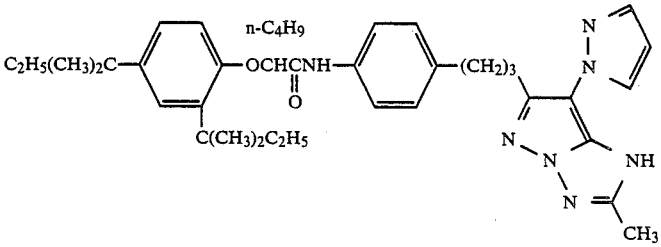
(M-32)

-continued
(M-33)
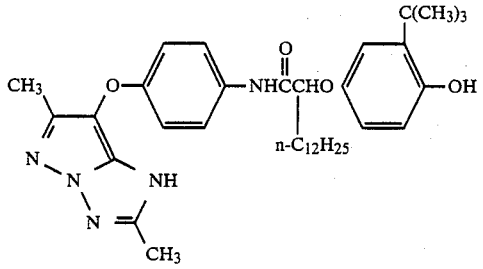
(M-34)
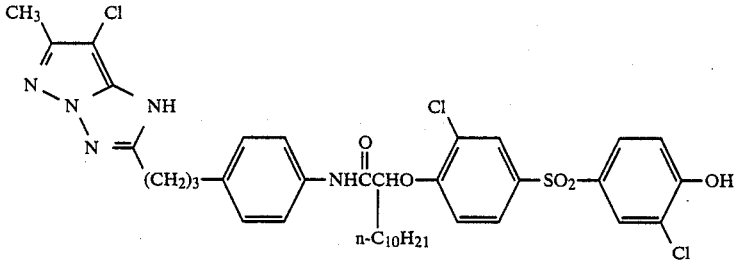
(M-35)
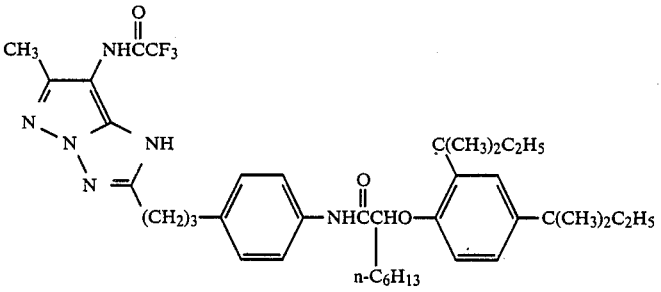
(M-36)
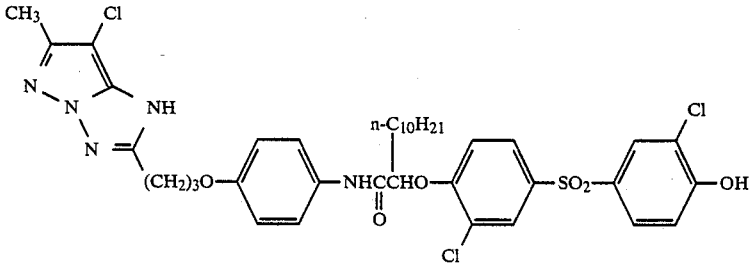
(M-37)
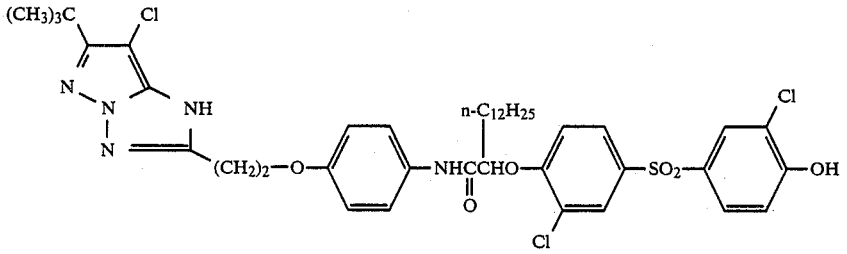
(M-38)
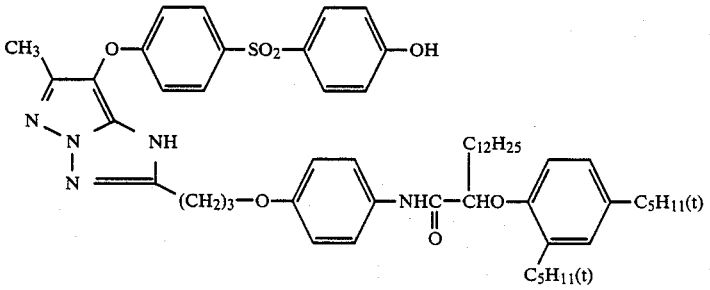

-continued
(M-39)
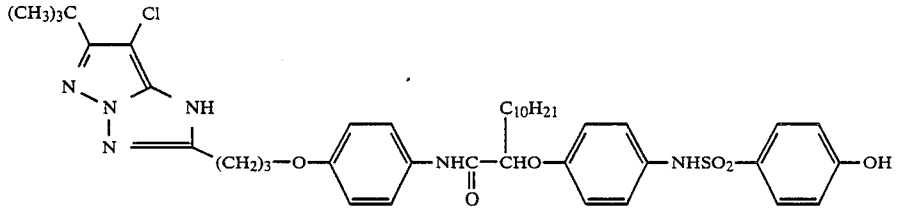
(M-40)
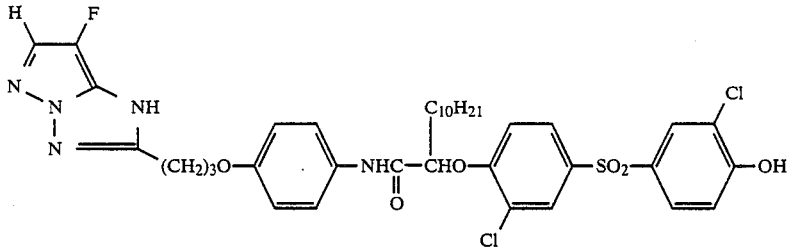
(M-41)
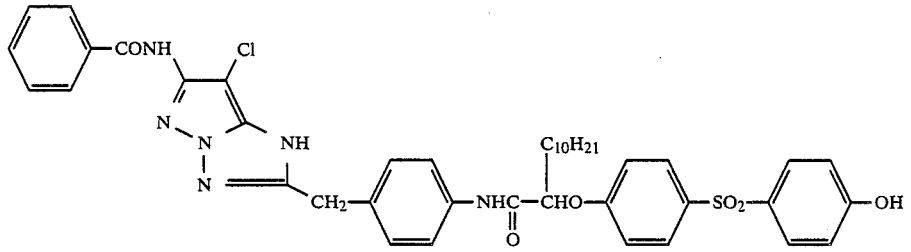
(M-42)
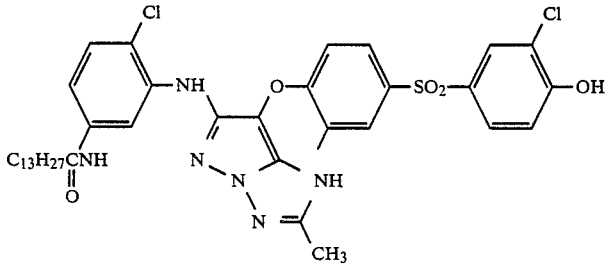
(M-43)
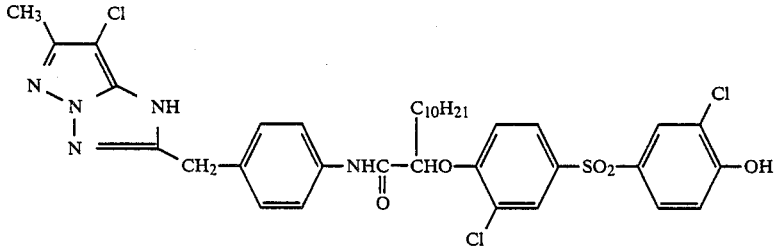
(M-44)
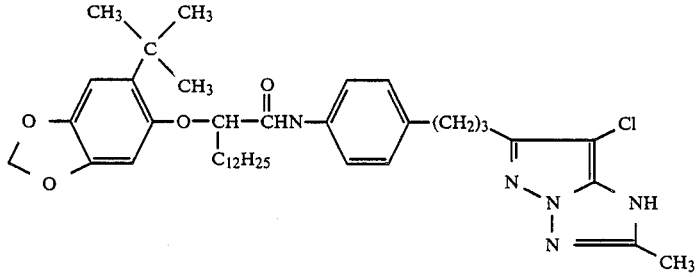

-continued
(M-45)
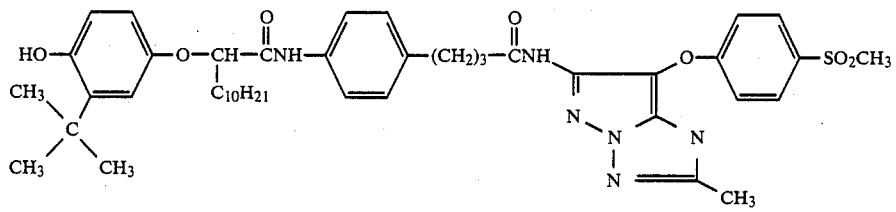
(M-46)
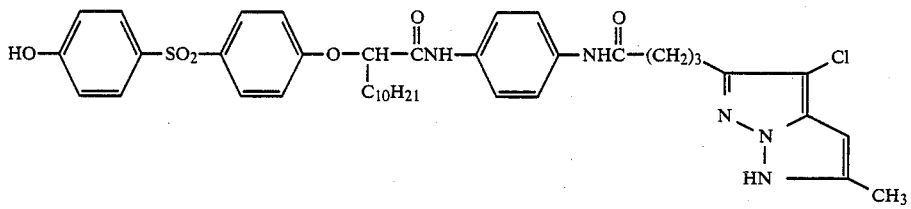
(M-47)
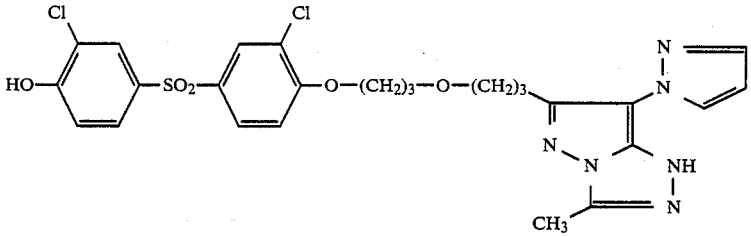
(M-48)
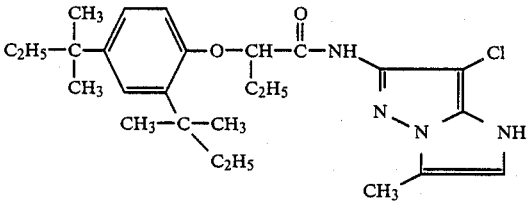
(M-49)
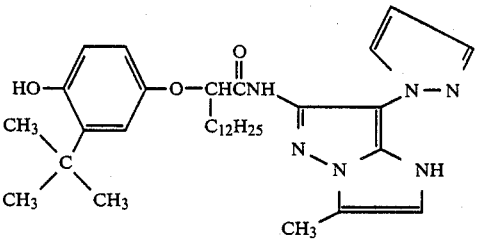
(M-50)
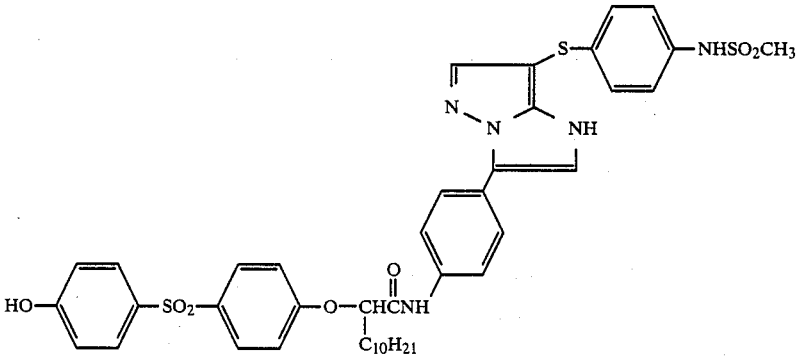

-continued
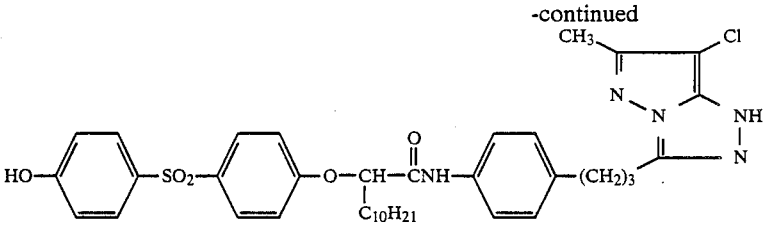
(M-51)
Concrete examples of the 2-equivalent magenta monomer coupler constituting the repeating unit of the general formula (Cp-2) of the present invention will be now shown, but it is to be understood that the invention is not limited to these examples.
(1)
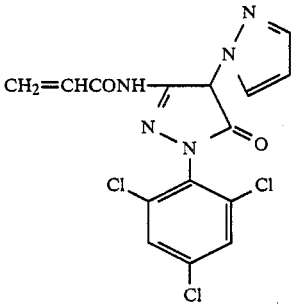
(2)
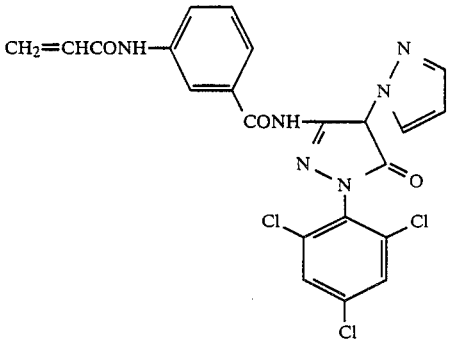
(3)
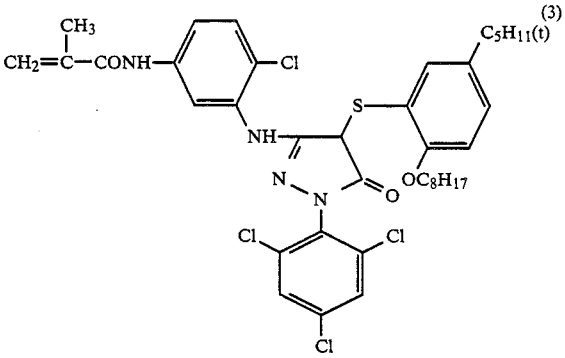
(4)
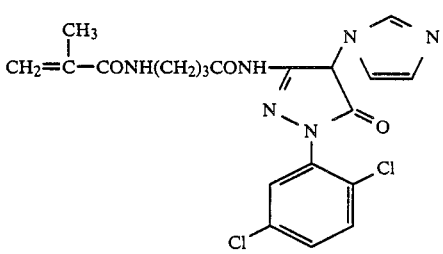
(5)
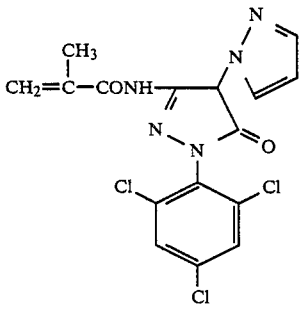
(6)
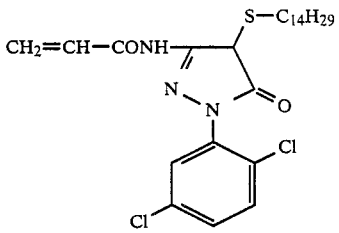
(7)
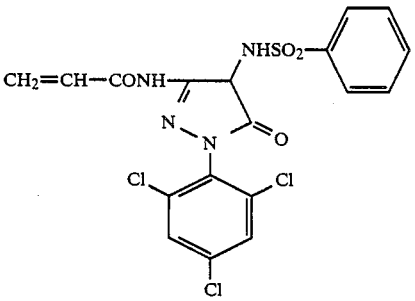
(8)
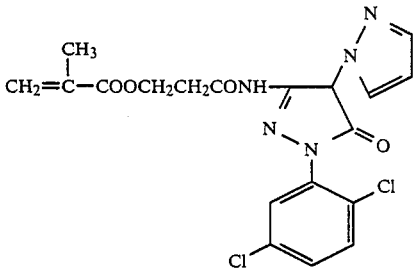

-continued
(9)
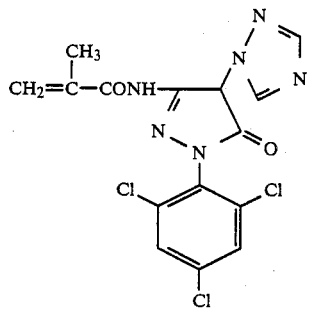
(10)
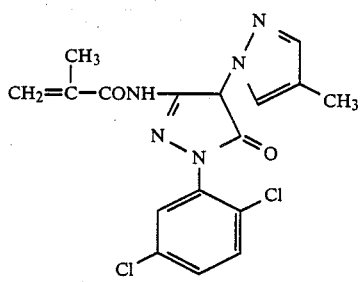
(11)
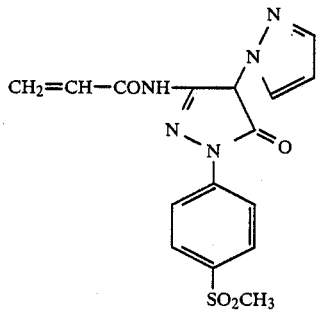
(12)
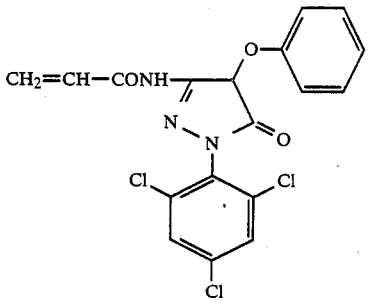
(13)
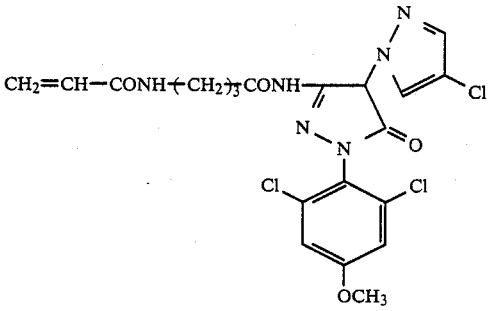
(14)
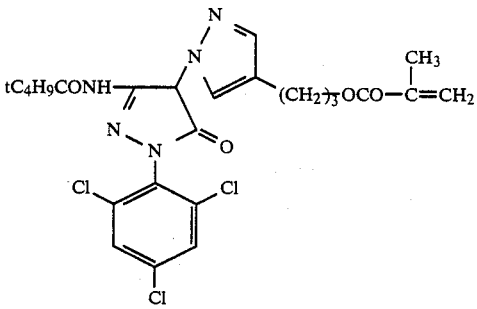
(15)
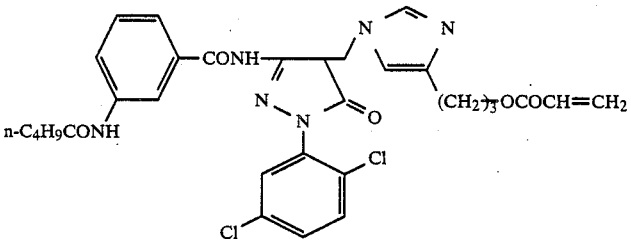
(16)
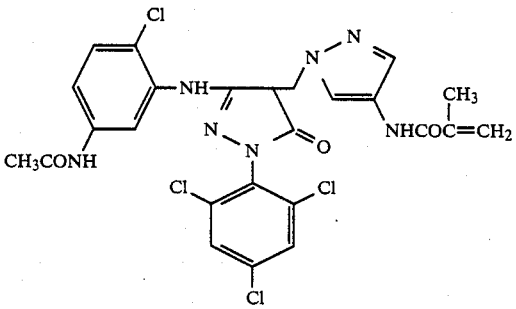

-continued
(17)
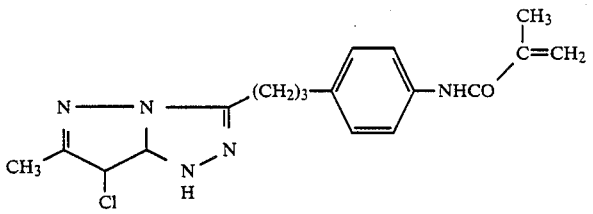
(18)
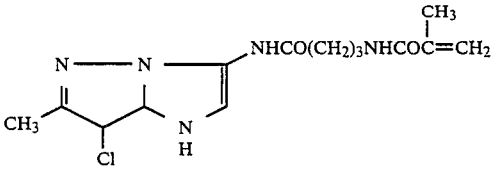
(19)
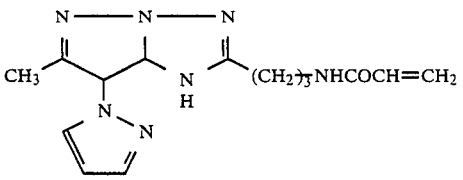
(20)
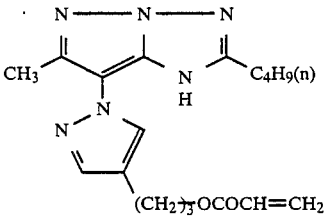
(21)
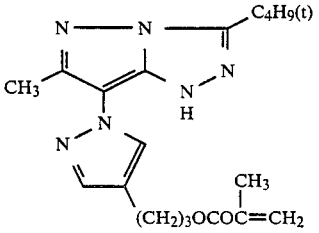
(22)
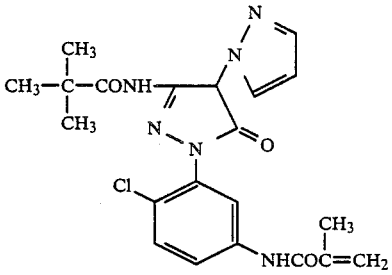
(23)
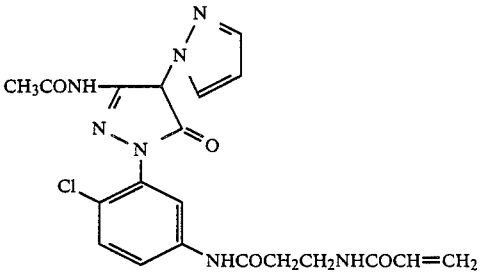
(24)
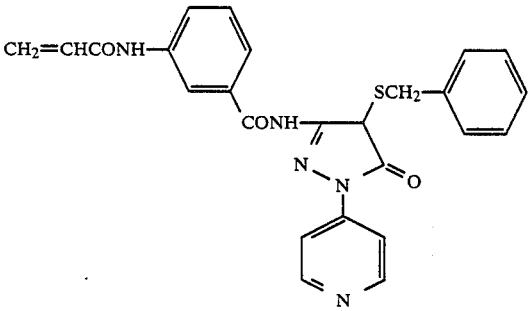
(25)
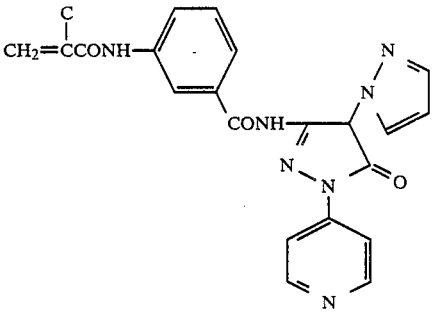
(26)
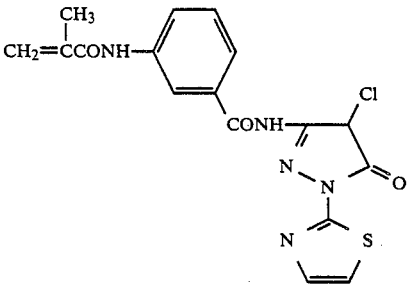
(27)
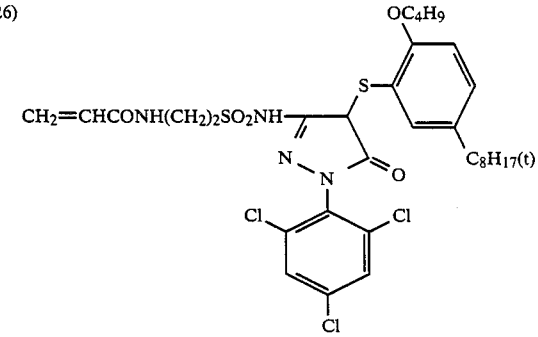

-continued (28)

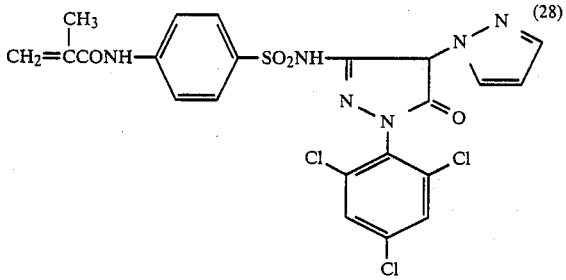

(29)

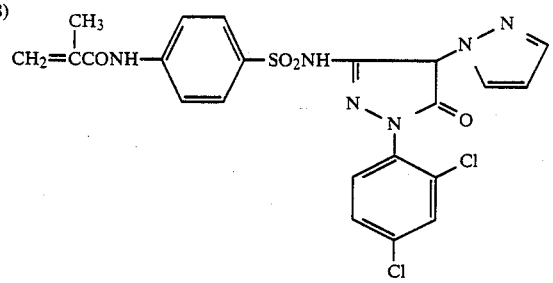

(30)

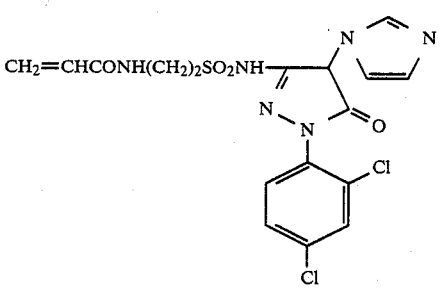

(31)

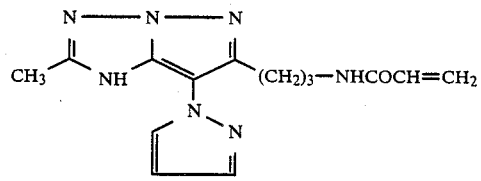

Examples of the polymer coupled used in the present invention will now be shown, but it is to be understood that the invention is not limited to these examples.

| Polymerizing Method | Polymer Coupler | Monomer (kind) | Coupler (amount) | Uncoupling Monomer (kind) | Uncoupling Monomer (amount) | Monomer Coupler in Polymer (wt %) |
|---|---|---|---|---|---|---|
| Solution Polymerization | M-52 | (1) | 50 g | n-BA | 50 g | 48.6 |
| | M-53 | (1) | 50 g | EHA | 20 g | 49.2 |
| | | | | St | 30 g | |
| | M-54 | (1) | 40 g | MA | 60 g | 40.1 |
| | M-55 | (2) | 50 g | n-BA | 50 g | 50.5 |
| | M-56 | (3) | 50 g | EA | 40 g | 51.7 |
| | | | | MMA | 10 g | |
| | M-57 | (4) | 60 g | n-BA | 40 g | 60.2 |
| | M-58 | (5) | 50 g | t-BMA | 50 g | 49.8 |
| | M-59 | (5) | 50 g | BA | 25 g | 48.3 |
| | | | | St | 25 g | |
| | M-60 | (5) | 50 g | BA | 50 g | 49.5 |
| | M-61 | (6) | 60 g | BA | 50 g | 48.9 |
| | M-62 | (8) | 50 g | EHA | 40 g | 61.5 |
| | M-63 | (10) | 50 g | BA | 30 g | 50.7 |
| | | | | -MST | 20 g | |
| | M-64 | (14) | 50 g | n-BA | 50 g | 51.6 |
| Emulsion Polymerization | M-65 | (19) | 40 g | n-BA | 50 g | 41.2 |
| | | | | MAA | 10 g | |
| | M-66 | (22) | 50 g | EA | 50 g | 50.3 |
| | M-67 | (25) | 50 g | n-BA | 30 g | 49.7 |
| | | | | St | 20 g | |
| | M-68 | (27) | 50 g | n-BA | 50 g | 51.5 |
| | M-69 | (1) | 50 g | n-BA | 50 g | 52.6 |
| | M-70 | (2) | 40 g | n-EA | 60 g | 40.7 |
| | M-71 | (5) | 50 g | n-BA | 30 g | 49.6 |
| | | | | St | 20 g | |
| | M-72 | (9) | 50 g | n-BA | 50 g | 52.4 |
| | M-73 | (14) | 50 g | MMA | 50 g | 53.1 |
| | M-74 | (31) | 40 g | n-BA | 60 g | 42.3 |

MA: methylacrylate
EHA: 2-ethylhexylacrylate
t-BMA: t-butylmethacrylate
EA: ethylacrylate
MMA: methylmethacrylate
St: styrene
n-BA: n-butylacrylate
MAA: methacrylic acid
-MSt: -methylstyrene In preparing the photosensitive material used in the present invention, incorporation of the coupler into the emulsion layer of silver halide is carried out using a known method, for example, the method disclosed in U.S. Pat. No. 2,322,027. The coupler may be dissolved, for example, in one of the following solvents: alkyl phthalate (dibutyl phthalate, dioctyl phthalate etc.);

phosphate (e.g. diphenyl phosphate, triphenyl phosphate, tricresyl phosphate, dioctyl butyl phosphate); citrate (e.g. tributyl acetyl citrate); benzoate (e.g. octyl benzoate); alkylamide (e.g. diethyllaurylamide); fatty acid ester (e.g. dibutoxy ethyl succinate, diethyl azelate); or trimesinate (e.g. tributyl trimesinate). The coupler may be dissolved also in an organic solvent having a boiling point of 30°–150° C. such as ethyl acetate, ethyl propionate, secondary butyl alcohol, methyl isobutyl ketone, β-ethoxyethyl acetate, or metylcellosolveacetic acid. After dissolution, the coupler is dispersed into an hydrophilic colloid. Organic solvents of high and low boiling point may be mixed with each other.

Further, there can be used the dispersion method with the polymers disclosed in Japanese Patent Publication No. 51-39853 and Japanese Unexamined Patent Publication No. 51-59943.

Where using the polymer coupler, the emulsified polymer may be directly added to the emulsion, or the polymer may be taken out, after the polymerization of the solution, and again dissolved into the organic solvent to be dispersed in the emulsion.

The required amount of the coupler according to the present invention varies with the purposes. Typically the amount is $2\times10^{-3}$ to 1 mol, more preferably $5\times10^{-3}$ to 0.5 mol per 1 mol silver halide contained in the layer.

The foregoing required amounts of the polymer coupler are expressed in terms of coloring coupler units.

The bleaching agent used in both the bleaching bath and the bleaching-and-fixing bath in the present invention is ferric complex salt aminopolycarboxylate, which is a complex compound derived from ferric ions and aminocarboxylic acid or its salts.

Typical examples of the aminopolycarboxylic acid and its salts are shown below, but it is to be understood that the invention is not limited to these examples.

| | |
|---|---|
| A-1 | Ethylenediaminetetraacetic acid |
| A-2 | Disodium ethylenediaminetetraacetate |
| A-3 | Diammonium ethylenediaminetetraacetate |
| A-4 | Tetra(trimethylammonium) ethylenediaminetetraacetate |
| A-5 | Tetrapotassium ethylenediaminetetraacetate |
| A-6 | Tetrasodium ethylenediaminetetraacetate |
| A-7 | Trisodium ethylenediaminetetraacetate |
| A-8 | Diethylenetriaminepentaacetic acid |
| A-9 | Pentasodium diethylenetriaminepentaacetate |
| A-10 | Ethylenediamine-N—(β-oxyethyl)-N,N',N'—triacetic acid |
| A-11 | Trisodium ethylenediamine-N—(β-oxyethyl)-N,N',N'—triacetate |
| A-12 | Triammonium ethylenediamine-N—(β-oxyethyl)-N,N',N'—triacetate |
| A-13 | 1,3-Propylenediaminetetraacetic acid |
| A-14 | Disodium-1,3-propylenediaminetetraacetate |
| A-15 | Nitrilotriacetic acid |
| A-16 | Trisodium nitrilotriacetate |
| A-17 | Cyclohexanediaminetetraacetic acid |
| A-18 | Diammonium cyclohexanediaminetetraacetate |
| A-19 | Iminodiacetic acid |
| A-20 | Dihydroxyethyl glycine |
| A-21 | Ethyl ether diaminetetraacetic acid |
| A-22 | Glycol ether diamineteraacetic acid |
| A-23 | Ethylenediaminetetrapropionic acid |
| A-24 | 1,2-Propylenediaminetetraacetic acid |
| A-25 | Diammonium 1,2-Propylenediaminetetraacetiate |

The more preferable examples are A-1 through A-3, A-8, A-13, A-14 and A-17 through A-19.

The ferric complex salt aminopolycarboxylate may be used in the form of the complex salt, or it may be obtained in the solution by using a ferric salt and aminopolycarboxylic acid. The ferric salt can, for example, be ferric sulfate, ferric chloride, ferric nitrate, ferric ammonium sulfate or ferric phosphate. In using the complex salt, one or more kinds of the complex salts may be used. One or more kinds may also be used in the case of employing the method of obtaining the complex salt in the solution by using a ferric salt and aminopolycarboxylic acid. Furthermore, one or more kinds of aminopolycarboxylic acid may be used. In any of the above methods, a greater amount of the aminopolycarboxylic acid than required may be used for obtaining the ferric ion complex salt.

The bleaching solution and the bleaching-and-fixing solution containing the above ferric ion complex compounds may further contain the complex salt of other metals than iron, such as cobalt and copper.

The bleaching solution according to the present invention may contain, aside from the bleaching agent and the above compounds, re-halogenation agents, such as bromide (e.g. potassium bromide, sodium bromide, and ammonium bromide), and chloride (e.g. potassium chloride, sodium chloride, and ammonium chloride). The bleaching solution may further contain known additives ordinarily used in bleaching solution such as one or more kinds of inorganic or organic acids having pH buffer ability, or their salts. Concrete examples of these acids are nitrates (e.g sodium nitrate, ammonium nitrate etc.), boric acid, borax, sodium methaborate, acetic acid, sodium acetate, sodium carbonate, potassium carbonate, phosphorus acid, phosphoric acid, sodium phosphate, citric acid, sodium citrate, and tartaric acid.

In the invention, the amount of the bleaching agent per liter of bleaching solution is 0.1–1 mol preferably 0.2–0.5 mol. The pH of the bleaching agent is regulated in use to 4.0–8.0, preferably to 5.0–6.5.

In the invention, the amount of the bleaching agent per liter of bleaching-and-fixing solution is 0.05–0.5 mol, preferably 0.1–0.3 mol.

In the invention, it is preferable that the bleaching bath contain a bleaching accelerator.

The bleaching accelerator to be included in the bleaching bath is selected from the group of compounds having a mercapto group or disulfide bond, thiazolidine derivatives, and isothiourea derivatives; provided that the compounds to be selected are limited, of course, to those having bleaching accelerating ability. The preferable bleaching acclerators are represented by the following general formulas (III)–(IX).

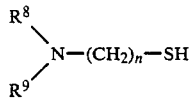

General formula (III)

In the formula, $R^8$ and $R^9$, which may be the same or different, represent a hydrogen atom, a substituted or unsubstituted lower alkyl group (preferably containing 1 to 5 carbon atoms, especially a methyl group, and ethyl group, or a propyl group), or an acyl group (preferably containing 1 to 3 carbon atoms, for example an acetyl group or a propionyl group). The symbol n represents an integer between 1 and 3.

$R^8$ and $R^9$ may be connected to each other to form a ring.

$R^8$ and $R^9$ are preferably substituted or unsubstituted lower alkyl groups.

The substituents of $R^8$ and $R^9$ are, for example, hydroxyl groups, carboxyl groups, sulfo groups, or amino groups.

General formulas (IV)

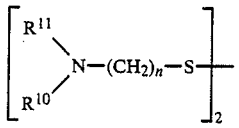

In the formula, $R^{10}$ and $R^{11}$ have the same meaning as $R^8$ and $R^9$ of the general formula (III). The symbol n represents 1, 2 or 3.

$R^{10}$ and $R^{11}$ may be connected to each other to form a ring.

$R^{10}$ and $R^{11}$ are preferably substituted or unsubstituted lower alkyl groups.

The substituents of $R^{10}$ and $R^{11}$ are, for example, hydroxyl groups, carboxyl groups, sulfo groups, or amino groups.

General formula (V)

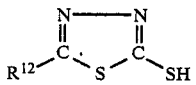

General formula (VI)

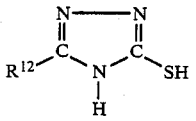

General formula (VII)

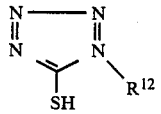

In these formulas, $R^{12}$ represents a hydrogen atom; a halogen atom (e.g. a chlorine atom, a bromine atom etc.); an amino group; a substituted or unsubstituted lower alkyl group (preferably containing 1 to 5 carbon atoms, especially a methyl group, an ethyl group, or a propyl group); or an amino group containing alkyl groups (a methylamino group, an ethylamino group, a dimethylamino group, or a diethylamino group etc.).

The substituents of $R^{12}$ are, for example, hydroxyl groups, carboxyl groups, sulfo groups, and amino groups.

General formula (VIII)

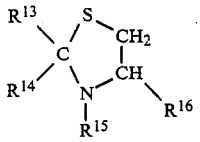

In the formula, R13 and R14, which may be the same or different, each represents a hydrogen atom; an alkyl group which may contain substituents (preferably a lower alkyl group, e.g. a methyl group, an ethyl group, a propyl group etc.); a phenyl group which may contain substituents, a heterocyclic group which may contain substituents (more specifically a heterocyclic group containing at least one hetero atom such as nitrogen atom, oxygen atom, or sulfur atom; examples of this heterocyclic group being a pyridine ring, a thiophene ring, a thiazolidine ring, a benzooxazole ring, a benzotriazole ring, a thiazole ring, an imidazole ring etc.).

$R^{15}$ represents a hydrogen atom or lower alkyl group which may contain substituents (e.g. a methyl group, an ethyl group etc.; preferably having 1 to 3 carbon atoms).

The substituents $R^{13}$ through $R^{15}$ are, for example, hydroxyl groups, carboxyl groups, sulfo groups, amino groups, and lower alkyl groups.

$R^{16}$ represents a hydrogen atom or a carboxyl group.

General formula (IX)

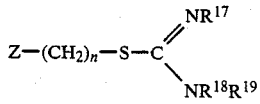

In the formula, R17, R18 and R19, which may be the same or different, each represents a hydrogen atom or lower alkyl group (e.g. a methyl group, an ethyl group etc.; preferably having 1 through 3 carbon atoms).

$R^{17}$ and $R^{18}$ or $R^{19}$ may be connected to each other to form a ring.

Z represents an amino group, a sulfo group, or a carboxyl group. These groups may contain substituents (e.g. lower alkyl groups such as methyl groups, or alkoxyalkyl groups such as acetoxymethyl).

$R^{17}$, $R^{18}$ and $R^{19}$ are each preferably a hydrogen atom, a methyl group, or an ethyl group; Z is preferably an amino group or a dialkylamino group.

In the invention, the bleaching accelerator is preferably a compound represented by the general formula (IV) to (VI).

In the present invention, it is preferable to contain the accelerator in an amount of $1\times10^{-5}$ to $1\times10^{-1}$ mol, more preferably $1\times10^{-4}$ to $5\times10^{-2}$ mol, most preferably $1\times10^{-3}$ to $1\times10^{-2}$ mol in the bleaching solution.

The fixing agent in the bleaching-and-fixing solution can be: a thiosulfate such as soidum thiosulfate, ammonium thiosulfate, ammonium sodium thiosulfate, or potassium sulfate; a thiocyanate such as sodium thiocyanate, ammonium thiocyanate, or potassium thiocyanate; thiourea; or thioether. The amount of the fixing agent per liter of bleaching-and-fixing solution is 0.3–3 mol, preferably 0.5–2 mol.

The bleaching-and-fixing solution according to the invention may contain, aside from the above bleaching agent and fixing agent, various additives as required.

For example, the bleaching-and-fixing solution may contain one or more kinds of the following pH regulators: a sulfite such as sodium sulfite or ammonium sulfite; boric acid; borax; sodium hydroxide; potassium hydroxide; sodium carbonate; potassium carbonate; sodium bicarbonate; acetic acid; and sodium acetate. The bleaching-and-fixing solution may further contain: an alkali metal halides such as potassium iodide, potassium bromide, and ammonium bromide; ammonium halides; and bisulfurous acid addition products of hydroxylamine, hydrazine, and aldehyde compounds.

The pH of the bleaching-and-fixing solution according to the invention is 5–8, preferably 6–7.5.

In the invention, the bleaching time is preferably 20 seconds to 4 minutes, more preferably 20 seconds to 2 minutes.

The bleaching-and-fixing time is preferably 1 to 5 minutes, more preferably 1.5 minutes to 3.5 minutes.

In the invention, the overflow solution from the bleaching bath and the fixing bath may be incorporated into the bleaching-and-fixing bath. By "overflow solution" is meant the spent bleaching solution discharged from the bleaching bath upon the addition of replenisment bleaching solution to the bleaching bath, and the spent fixing solution discharged from the fixing bath upon the addition of replenishment fixing solution to the fixing bath.

Normally all of both the overflow solution of the bleaching bath and the overflow solution of the fixing bath are incorporated into the bleaching-and-fixing bath, but the two overflow solutions that may be used is a suitable rate appropriate for the kind of photosensitive material and its purpose.

In the invention, a washing step may be provided between the bleaching step and the bleaching-and-fixing step. In this case, even if the washing step uses a small-capacity washing bath supplied with only a very small amount of water, there will be no reduction in the effects of the invention whatsoever.

The processing method of the present invention is applied to a silver halide color photosensitive material containing silver halide in an amount of 2 to 12 g per $m^2$, preferably 3 to 10 g per $m^2$.

Examples of the color photosensitive material include color photosensitive materials for taking photographs, such as color negative films.

The photographic emulsion of the photosensitive material used in the invention may contain any of the following silver halides: silver bromide, silver bromoiodide, silver bromochloroiodide, silver chlorobromide, and silver chloride. Preferable silver halides are silver bromoiodide and silver bromochloroiodide containing silver iodide at less than 30 mol%. The most preferable one is silver bromoiodide containing silver iodide at 2 to 25 mol%.

In particular, the processing method of the present invention is preferably applied to a color photosensitive material containing silver bromoiodide containing silver iodide at 2 to 25 mol%, most preferably 4 to 20 mol%.

The silver halide grains in the photographic emulsion can be so-called regular grains of a regular crystalline form such as cubic, octahedronal, or tetradecahedronal; grains having crystal defects such as twin crystal; or a mixture thereof.

The grain size of the silver halide may be very small grains (0.1 microns or less) or as large as 10 microns in the diameter of the projection area. Further, the silver halide may be in the form of a single-dispersion emulsion having narrow distribution, or the multi-dispersion emulsion having broad distribution.

The silver halide photographic emulsion used in the invention can be produced by a known method. See, for example, Research Disclosure (RD) No. 17643 (December, 1978), Pages 22–23, "I. Emulsion preparation and types", and No. 18716 (November, 1979), Page 648.

The photographic emulsion used in the invention can be prepared by using a method as disclosed in: Glafkides, "Chimie et Physique Photographique", Paul Montel, 1967; G. F. Duffin, "Photographic Emulsion Chemistry", Focal Press, 1966; and V. L. Zelikman et al, "Making and Coating Photographic Emulsion", Focal Press, 1964. That is, the method used may be any of the acidic method, the neutral method, and the ammonia method. Considering the reaction type between the soluble silver salt and the soluble halides, there may be used any of the one-sided mixing method, the simultaneous mixing method, and their combination. The particles may be formed under the condition of excessive silver ions (so-called reverse mixing method). As a simultaneous mixing method, there may be used the method of maintaining the pAg of the solution, in which solution the silver halide generates constant namely the so-called controlled double jet method. Using this method, there can be obtained a silver halide emulsion having regular crystal shape and nearly constant-sized grains.

There may be used a mixture of two or more kinds of silver halide emulsion.

The silver halide emuslion comprising the abovementioned regular grains can be obtained by regulating the pAg and pH during grain formation. The details of this regulating method are disclosed, for example, in: "Photographic Science and Engineering", Volume 6, Pages 159–165 (1962); "Journal of Photographic Science", Volume 12, Pages 242–251 (1964); U.S. Pat. No. 3,655,394; and British Pat. No. 1,413,748.

A typical example of the single-dispersion emulsion is one in which the average diameter of the silver halide grains is larger than 0.1 microns, and at least 95 weight% of the grains are within the range of ±40% of the average diameter. In the invention, there can be used an emulsion in which the average diameter of the silver halide grains is 0.25–2 microns, and at least 95 weight% or at least 95 number% of the grains are within the range of ±20% of the average diameter. The method of producing the above emulsion is disclosed in U.S. Pat. No. 1,413,748. Further, it is preferable in the invention to use the single-dispersion emulsion as disclosed in Japanese Unexamined Patent Publication Nos. 48-8600, 51-39027, 51-83907, 53-137133, 54-48521, 54-99419, 58-37635, and 58-49938.

In the invention there may be used plate-like grains having an aspect ratio of more than five. The plate-like grains are easily prepared by using the methods disclosed in: Gutoff, "Photographic Science and Engineering", Volume 14, Pages 248–257 (1970); U.S. Pat. Nos. 4,434,226, 4,414,310, 4,433,048, and 4,439,520; and British Pat. No. 2,112,157. Use of the plate-like grains gives the advantages of increased efficiency of the photochemical sensitization derived from the sensitive coloring matters, enhanced graininess, and the increased sharpness. These advantages are described in detail in the above-mentioned U.S. Pat. No. 4,434,226.

The crystal structure may be uniform, may consist of halogen compositions which differ between the outer part and the inner part, or may be layered. These emulsion structures are disclosed in British Pat. No. 1,027,146, U.S. Pat. Nos. 3,505,068 and 4,444,877, Japanese Patent Application No. 58-248469 etc. Further, the silver halide may be connected, by epitaxial junction, to other silver halides having a different composition, or may be connected to other compounds than the silver halides, such as silver thiocyanate and lead oxide. These emulsion grains are disclosed in: U.S. Pat. Nos. 4,094,684, 4,142,900 and 4,459,353; British Pat. No. 2,038,792; U.S. Pat. Nos. 4,349,622, 4,395,478, 4,433,501, 4,463,087, 3,656,962 and 3,852,067; Japanese Unexamined Patent Publication No. 59-162540 etc.

There may also be used mixtures of grains of the various crystal shapes.

The invention usually uses an emulsion which has been subjected to the physical ageing, chemical ageing, and spectral sensitization. The additives used in these processes are disclosed in Research Disclosure, Nos. 17643 and 18716 at the locations indicated in the following table.

The known photographic additives applicable to the invention are described also in the above two number of Research Disclosure at the locations indicated in the following table.

| | Kind of Additive | RD 17643 | RD 18716 |
|---|---|---|---|
| 1 | Chemical sensitizing agent | Page 23 | Page 648, Right col. |
| 2 | Sensitivity increasing agent | | Page 648, Right col. |
| 3 | Spectral sensitizing agent and Strong photochemical sensitizing agent | Pages 23–24 | Page 648, Right col. to Page 649, Right col. |
| 4 | Anti-fogging agent and Stabilizer | Pages 24–25 | Page 649, Right col. |
| 5 | Light absorbing agent and Filter color ultraviolet absorbing agent | Pages 25–26 | Page 649, Right col. to Page 650, Left col. |
| 6 | Anti-stain agent | Page 25 Right col. | Page 650, Left col. to Right col. |
| 7 | Hardening agent | Page 26 | Page 651, Left col. |
| 8 | Binder | Page 26 | Page 651, Left col. |
| 9 | Plasticizer and Lubricant | Page 27 | Page 650, Right col. |
| 10 | Coating assistant and Surface-active agent | Pages 26–27 | Page 650, Right col. |
| 11 | Antistatic agent | Page 27 | Page 650, Right col. |

Various color couplers can be used in the invention. Specific examples are disclosed in the patents referred to in the above-mentioned Research Disclosure (RD), No. 17643, VII-C through G. As regards dye forming coupler, it is important for it to be one that gives the primary colors (subtractive), i.e. yellow, magenta and cyan, by color development. Specific examples of the diffusion resistant, 4- or 2-equivalent couplers used preferably in the invention are, aside from those disclosed in the patents referred to in the abovementioned RD, 17643, VII-C and D, the couplers described below.

The typical yellow coupler usable in the invention is the hydrohobic acylacetamide-type coupler containing the ballast group, specific examples being disclosed in U.S. Pat. Nos. 2,4047,210, 2,875,057, 3,265,506 etc. It is preferable in the invention to use the 2-equivalent yellow coupler, of which typical examples are the yellow couplers of oxygen atom elimination type disclosed in U.S. Pat. Nos. 3,408,194, 3,447,928, 3,933,501 and 4,022,620, and the yellow couplers of nitrogen atom elimination type as disclosed in: Japanese Patent Publication No. 58-10739; U.S. Pat. Nos. 4,401,752 and 4,326,024; RD 18053 (April, 1979); British Patent No. 1,425,020; and West German Patent Unexamined Publication Nos, 2,219,917, 2,261,361, 2,329,587 and 2,433,812. The α-privaloylacetoanilide-type coupler is superior in the fastness of the coloring matters, especially in the photofastness. On the other hand, the α-benzoylacetoanilide-type coupler gives high coloring density.

The auxiliary magenta coupler usable with the main coupler in the invention may be a hydrohobic indazolone-type or cyanoacetyl-type coupler containing a ballast group, and is preferably a 5-pyrazolone type or pyrazoloazole-type coupler. It is preferable that the 5-pyrazolone-type coupler be one in which the third site is substituted by the arylamino group or acylamino group in view of the hue of the coloring matters and coloring density. Typical examples are disclosed in U.S. Pat. Nos. 2,311,082, 2,343,703, 2,600,788, 2,908,573, 3,062,653, 3,152,896, 3,936,015 etc.

The cyan coupler usable in the invention may be a hydroboric naphthol-type or phenol-type coupler which is diffusion resistant. Typical examples are the naphytyol-type coupler disclosed in U.S. Pat. No. 2,474,293, and the oxygen atom elimination type, 2-equivalent, naphthol-type couplers disclosed in U.S. Pat. Nos. 4,052,212, 4,146,396, 4,228,233 and 4,296,200, which are preferable. Examples of the phenol-type coupler are disclosed in U.S. Pat. Nos. 2,369,929, 2,801,171, 2,772,162, 2,895,826 etc. It is preferable in the invention to use the cyan coupler because it is fast to humidity and temperature. Typical examples are: the phenol-type cyan coupler containing, at the meta-site of the phenol core, an alkyl group not lower than the methyl group, disclosed in U.S. Pat. No. 3,772,002; the 2,5-diacylamino substitution phenol-type coupler disclosed in U.S. Pat. Nos. 2,772,162, 3,758,308, 4,126,396, 4,334,011 and 4,327,173, West German patent unexamined publication No. 3,329,729, European Pat. No. 121,365 etc.; and the phenol-type coupler containing a unreido group at the second site, and an acylamino group at the fifth site, disclosed in U.S. Pat. Nos. 3,446,622, 4,333,999, 4,451,559 and 4,427,767.

It is preferable to additionally use a colored coupler in the preparation of the photographic color photosensitive material for the masking, in order to correct the unrequired absorption of the coloring matters. Typical examples are: the yellow coloring magenta coupler as disclosed in U.S. Pat. No. 4,163,670 and Japanese patent publication No. 57-39413; and the magenta coloring cyanogen coupler as disclosed in U.S. Pat. Nos. 4,004,929 and 4,138,258, and British Pat. No. 1,146,368. Other colored couplers can be found in the above-mentioned RD 17643, VII-G.

It is possible to additionally use a coupler in which the colored dyes have appropriate diffusibility to improve the graininess. Examples of such couplers are the magenta coupler disclosed in U.S. Pat. No. 4,366,237 and British Pat. No. 2,125,570; and the yellow, magenta or cyan couplers disclosed in European Pat. No. 96,570 and West German unexamined patent publication No. 3,234,533.

The dye forming coupler and the above special couplers may be a polymer not lower than the dimer. Typical examples of the polymerized dye forming coupler are disclosed in U.S. Pat. Nos. 3,451,820 and 4,080,211. Typical examples of the polymerized magenta coupler are disclosed in British Pat. No. 2,102,173 and U.S. Pat. No. 4,367,282.

It is preferable in the invention to use a coupler which discharges, at the time of coupling, remaining groups which are photographically useful. A useful example of a DIR coupler discharging developing restrainer is disclosed in the above-mentioned RD 17643, VII-F.

Preferred couplers which can be combined with the invention are: the developing agent deactivation type coupler, a typical one of which is disclosed in Japanese unexamined patent publication No. 57-151944; the timing type coupler, typical ones of which are disclosed in U.S. Pat. No. 4,248,962 and Japanese unexamined patent publication No. 57-154234; and the reaction type coupler, a typical one of which is disclosed in Japanese patent application No. 59-39653. The most preferable ones are: the developing agent deactivation type DIR coupler as disclosed in Japanese patent unexamined publication Nos. 57-151944 and 58-217932, and Japanese patent application Nos. 59-75474, 59-82214 and 59-90438; and the reaction type DIR coupler as disclosed in Japanese patent application No. 59-39653.

Appropriate base materials usable in the invention are disclosed, for example, in the above-mentioned RD. No. 17643, Page 28, and No. 18716, Page 647, Right column to Page 648, Left column.

The silver halide color photosensitive material to which the invention is applied may itself contain the color developing agent.

The processing method according to the invention comprises, as described above, the color developing step, the bleaching step, the bleaching-and-fixing step etc., wherein the bleaching-and-fixing step is usually followed by a washing step and a stabilizing step, but it is possible to use a simple procedure in which, after the bleaching-and-fixing step, the stabilizing step is carried out without substantial washing.

The washing water used in the washing step may contain, as required, such known additives: as a chelating agent such as inorganic phosphate, aminopolycarboxylic acid, or organic phosphate; a bactericide and antimold agent for preventing propagation of various bacteria and fungi; a hardening agent such as magnesium salt or aluminium salt; and a surface active agent for preventing dry load and unevenness. The additives may also be the compounds as disclosed in "Phot. Sci. and Eng.", Vol. 9, No. 6, Pages 344–359 (1965). It is preferable to regulate the water temperature 20°–50° C., more preferably 30°–40° C.

The washing step may use, as required, two or more tanks. Further, the washing step may use the multistage (e.g. 2- to 9-stage) countercurrent washing method to save washing water.

The stabilizing solution used in the stabilizing step is for stabilizing the color image. Examples of the stabilizing solution are a solution having buffer action and having a pH of 3–6; and a solution containing aldehyde (e.g. formalin). The stabilizing solution may contain, as required, an optical whitening agent, a chelating agent, a bactericide, an antimold agent, a hardening agent, a surface active agent etc.

Further, the stabilizing step may use, as required, two or more tanks. The stabilizing step may use a multistage (e.g. 2- to 9-stage) countercurrent stabilization method to save stabilizing solution. The washing step may be omitted.

EXAMPLES

The present invention will be explained in detail below, but it is to be understood that the invention is not limited to these examples.

EXAMPLE 1

Sample 101

There was produced, on a support made of triacetyl cellulose film, a multilayer color photosensitive material sample consisting of layers having the following compositions.

| | |
|---|---|
| The first layer (antihalation layer) | |
| A gelatin layer containing black colloid silver | |
| The second layer (intermediate layer) | |
| A gelatin layer containing emulsified dispersion compounds of 2,5-di-t-octylhydroquinone | |
| The third layer (low sensitivity red sensitive emulsion layer) | |

-continued

| | |
|---|---|
| Silver bromoiodide emulsion (silver iodide: 5 mol %) | amount of silver coating: 1.6 g/m$^2$ |
| Sensitizing dye I | $6 \times 10^{-5}$ mol per 1 mol silver |
| Sensitizing dye II | $1.5 \times 10^{-5}$ mol per 1 mol silver |
| Coupler EX-1 | 0.04 mol per 1 mol silver |
| Coupler EX-2 | 0.003 mol per 1 mol silver |
| Coupler EX-3 | 0.0006 mol per 1 mol silver |
| The fourth layer (high-sensitivity red sensitive emulsion layer) | |
| Silver bromide iodide emulsion (silver iodide: 10 mol %) | amount of silver coating: 1.4 g/m$^2$ |
| Sensitizing dye I | $3 \times 10^{-5}$ mol per 1 mol silver |
| Sensitizing dye II | $1.2 \times 10^{-5}$ mol per 1 mol silver |
| Coupler EX-4 | 0.02 mol per 1 mol silver |
| Coupler EX-2 | 0.0016 mol per 1 mol silver |
| The fifth layer (intermediate layer) | |
| Same as the second layer | |
| The sixth layer (low sensitivity green sensitive emulsion layer) | |
| Single-dispersion silver bromoiodide emulsion (silver iodide: 4 mol %) | amount of silver coating: 1.2 g/m$^2$ |
| Sensitizing dye III | $3 \times 10^{-5}$ mol per 1 mol silver |
| Sensitizing dye IV | $1 \times 10^{-5}$ mol per 1 mol silver |
| Coupler EX-5 | 0.05 mol per 1 mol silver |
| Coupler EX-6 | 0.008 mol per 1 mol silver |
| Coupler EX-3 | 0.0015 mol per 1 mol silver |
| The seventh layer (high sensitivity green sensitive emulsion layer) | |
| Silver bromoiodide emulsion (silver iodide: 10 mol %) | amount of silver coating 1.3 g/m$^2$ |
| Sensitizing dye III | $2.5 \times 10^{-5}$ mol per 1 mol silver |
| Sensitizing dye IV | $0.8 \times 10^{-5}$ mol per 1 mol silver |
| Coupler EX-5 | 0.017 mol per 1 mol silver |
| Coupler EX-6 | 0.003 mol per 1 mol silver |
| The eighth layer (yellow filter layer) | |
| A gelatin layer containing, in a gelatin aqueous solution, yellow colloid, silver and emulsified dispersion compounds of 2,5-di-t-octylhydroquinone. | |
| The ninth layer (low-sensitivity blue sensitive emulsion layer) | |
| Silver bromoiodide emulsion (silver iodide: 6 mol %) | amount of silver coating 0.7 g/m$^2$ |
| Coupler EX-9 | 0.25 mol per 1 mol silver |
| Coupler EX-3 | 0.015 mol per 1 mol silver |
| The tenth layer (high-sensitivity blue sensitive emulsion layer) | |
| Silver bromoiodide (silver iodide: 6 mol %) | amount of silver coating: 0.6 g/m$^2$ |
| Coupler EX-9 | 0.06 mol per 1 mol silver |
| The eleventh layer (first protective layer) | |
| Silver bromoiodide (silver iodide: 1 mol %, average diameter: 0.07μ) | amount of silver coating: 0.5 g/m$^2$ |
| A gelatin layer containing the emulsified dispersion compounds of the ultraviolet ray absorbing agent UV-1 | |
| The twelfth layer (second protective layer) | |
| A gelatin layer containing particles of trimethylmethanoacrylate (about 1.5μ in diameter). | |

In addition to the above components, the gelatin hardening agent H-1 and a surface active agent were added to each of the above layers.

Compounds Used for Producing the Samples

The sensitizing dye I: pyridinium anhydro-5,5'-dichloro-3,3'-di-(γ-sulfopropyl)-9-ethyl-thiacarbocyaninehydroxide The sensitizing dye II: triethylamine anhydro-9-ethyl-3,3'-di-(γ-sulfopropyl)-4,5,4'-5'-dibenzothiacarbocyaninehydroxide The sensitizing dye III: sodium anhydro-9-ethyl-5,5'-dichloro-3,3'-di-(γ-sulfopropyl)oxacarbocyaninehydroxide
The sensitizing dye IV: sodium anhydro-5,6,5',6'-tetrachloro-1,1'-diethyl-3,3'-di-{β-[β-(γ-sulfopropyl)ethoxyl]}ethylimidazolocarbocyaninehydroxide
EX-1
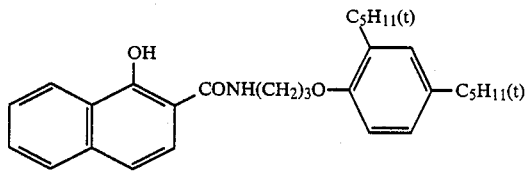
EX-2
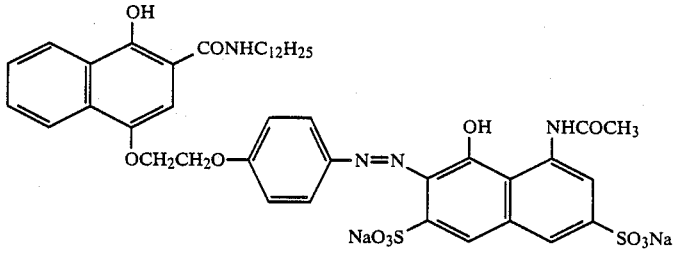
EX-3
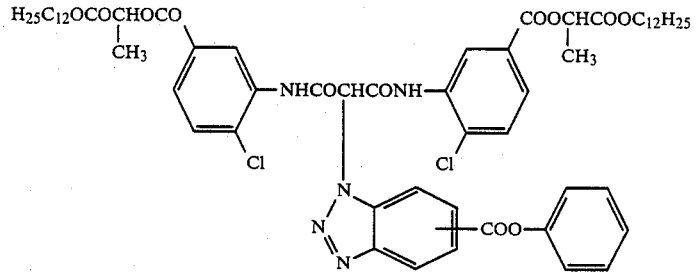
EX-4
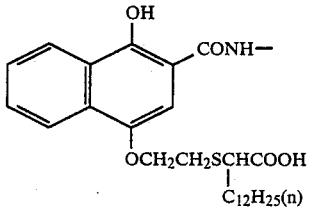
EX-5
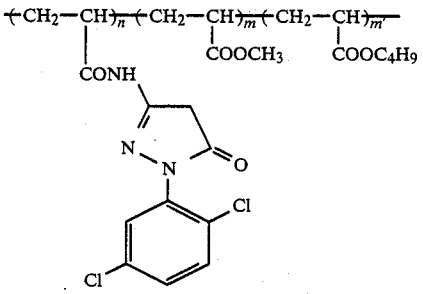
(n/m + m' = 1 m/m' = 1 (weight ratio)
EX-6
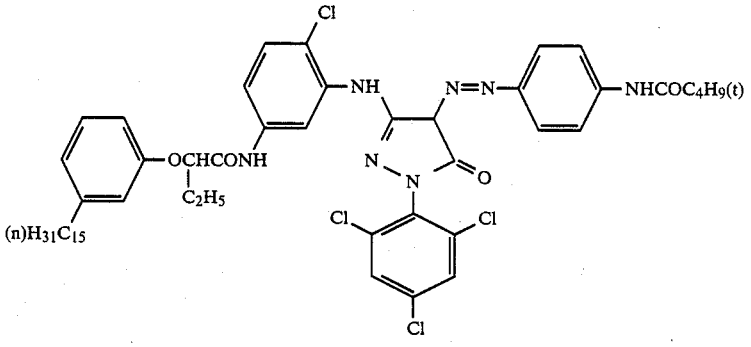

-continued
EX-7
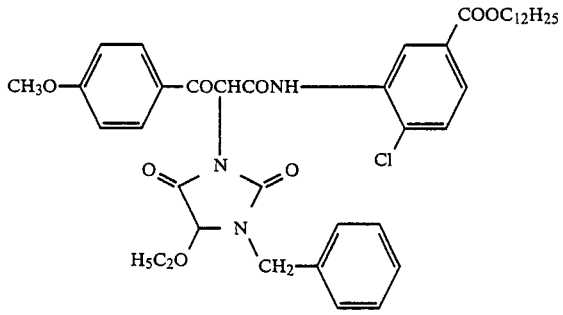
H-1
$CH_2{=}CH{-}SO_2{-}CH_2{-}CONH{-}(CH_2)_2NHCOCH_2SO_2CH{=}CH_2$
UV-1
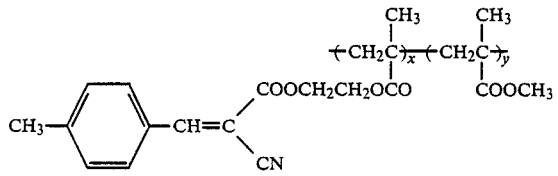
x/y = 7/3 weight ratio
EX7
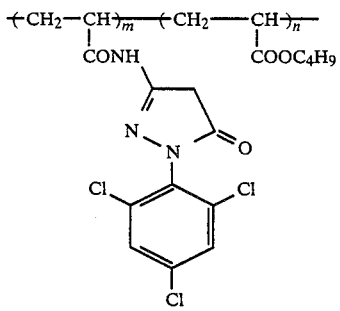
m/n = 1/1 weight ratio
EX8
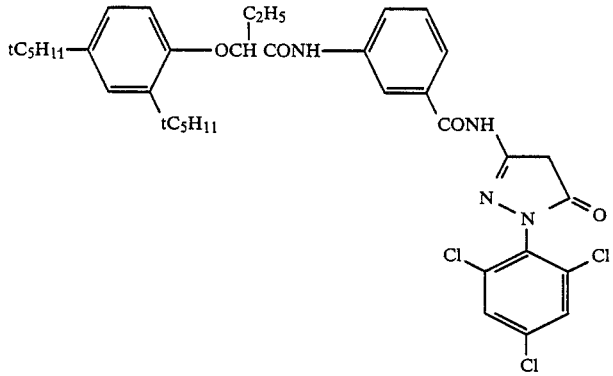
EX9
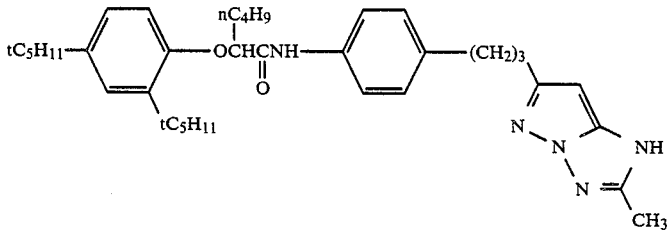

Sample 102

The coupler EX-5 of the sixth and seventh layers of the sample 101 was replaced by equimolar EX-7

Sample 103

The coupler EX-5 of the sixth and seventh layers of the sample 101 was replaced by equimolar EX-8

Sample 104

The coupler EX-5 of the sixth and seventh layers of the sample 101 was replaced by equimolar EX-9

Sample 105

The coupler EX-5 of the sixth and seventh layers of the sample 101 was replaced by equimolar M-8

Sample 106

The coupler EX-5 of the sixth and seventh layers of the sample 101 was replaced by equimolar M-28

Sample 107

The coupler EX-5 of the sixth and seventh layers of the sample 101 was replaced by equimolar M-32

Sample 108

The coupler EX-5 of the sixth and seventh layers of the sample 101 was replaced by equimolar M-52

Sample 109

The coupler EX-5 of the sixth and seventh layers of the sample 101 was replaced by equimolar M-59

Sample 110

The coupler EX-5 of the sixth and seventh layers of the sample 101 was replaced by equimolar M-74

These color negative films were processed by 25 cms wedge exposure using a tungsten light source. The wedge exposure was regulated at 4800° K. in color temperature by a filter. The thus treated film was developed at 38° C. using the following processing steps.

| Processing step 1 (for comparison) | |
|---|---|
| Color development | 3 minutes 15 seconds |
| Bleaching | time shown in Table 1 |
| Fixing | time shown in Table 1 |
| Washing | 3 minutes 15 seconds |
| Stabilization | 1 minute 5 seconds |

-continued

| Processing step 2 (according to the invention) | |
|---|---|
| Color development | 3 minutes 15 seconds |
| Bleaching | time shown in Table 1 |
| Fixing | time shown in Table 1 |
| Washing | 3 minutes 15 seconds |
| Stabilization | 1 minute 5 seconds |

The processing solutions used in the respective steps are shown below.

| | |
|---|---|
| Color developing solution | |
| Diethylenetriaminepentaacetic acid | 1.0 g |
| 1-dihydroxyethylidene-1,1'-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylaminesulfate | 2.4 g |
| 4-(N—ethyl-N—β-hydroxylethylamino)-2-methylanilinesulfate | 4.5 g |
| Water to bring total solution to | 1.0 l |
| pH | 10.0 |
| Bleaching solution | |
| Ferric ammonium etylenediaminetetraacetate | 100.0 g |
| Disodium etylenediaminetetraacetate | 8.0 g |
| Ammonium bromide | 150.0 g |
| Aqueous ammonia (28%) | 7.0 ml |
| Water to bring total solution to | 1 l |
| pH | 6.6 |
| Fixing solution | |
| Sodium ethylenediaminetetraacetate | 1.0 g |
| Sodium sulfite | 4.0 g |
| Aqueous ammonium thiosulfate (70%) | 175.0 ml |
| Sodium sulfite | 4.6 g |
| Water to bring total solution to | 1 l |
| pH | 6.6 |
| Bleaching and fixing solution | |
| Ferric ammonium ethylenediaminetetraacetate | 100.0 g |
| Disodium ethylenediaminetetraacetate | 4.0 g |
| Aqueous ammonium thiosulfate (70%) | 175.0 ml |
| Sodium sulfite | 4.5 g |
| Aqueous ammonia (28%) | 15 l |
| Water to bring total solution to | 1 l |
| pH | 6.8 |
| Stabilizing solution | |
| Formalin (40%) | 2.0 ml |
| Polyoxyethylene-p-monononyl phenyl ether (average polymerization degree ≈ 10) | 0.3 g |
| Water to bring total solution to | 1 l |

The amount of residual silver at the region of maximum color density was measured for each of the thus treated samples using florescent X-ray analysis. The results obtained are shown in Table 1.

TABLE 1

| | Sample No. | Film Sample No. | Desilverization Process Time: Bleaching | Bleaching-and-Fixing | Fixing | Residual Silver (μg/cm²) |
|---|---|---|---|---|---|---|
| Comparison Sample | 1 | 101 | 1 min. 45 sec. | Nothing | 3 min. | 16.2 |
| | 2 | 102 | 1 min. 45 sec. | Nothing | 3 min. | 16.1 |
| | 3 | 103 | 1 min. 45 sec. | Nothing | 3 min. | 18.0 |
| | 4 | 104 | 1 min. 45 sec. | Nothing | 3 min. | 18.0 |
| | 5 | 101 | 1 min. 45 sec. | 3 min. | Nothing | 6.0 |
| | 6 | 102 | 1 min. 45 sec. | 3 min. | Nothing | 7.0 |
| | 7 | 103 | 1 min. 45 sec. | 3 min. | Nothing | 7.2 |
| | 8 | 104 | 1 min. 45 sec. | 3 min. | Nothing | 6.8 |
| | 9 | 101 | 1 min. 30 sec. | 2 min. 30 sec. | Nothing | 10.0 |
| | 10 | 102 | 1 min. 30 sec. | 2 min. 30 sec. | Nothing | 10.8 |
| | 11 | 103 | 1 min. 30 sec. | 2 min. 30 sec. | Nothing | 9.8 |
| | 12 | 104 | 1 min. 30 sec. | 2 min. 30 sec. | Nothing | 10.6 |
| | 13 | 105 | 1 min. 45 sec. | Nothing | 3 min. | 16.2 |
| | 14 | 106 | 1 min. 45 sec. | Nothing | 3 min. | 16.1 |
| | 15 | 107 | 1 min. 45 sec. | Nothing | 3 min. | 16.3 |
| | 16 | 108 | 1 min. 45 sec. | Nothing | 3 min. | 16.4 |
| | 17 | 109 | 1 min. 45 sec. | Nothing | 3 min. | 16.0 |

TABLE 1-continued

| | Sample No. | Film Sample No. | Desilverization Process Time: Bleaching | Bleaching-and-Fixing | Fixing | Residual Silver ($\mu g/cm^2$) |
|---|---|---|---|---|---|---|
| | 18 | 110 | 1 min. 45 sec. | Nothing | 3 min. | 16.2 |
| Invention Sample | 19 | 105 | 1 min. 45 sec. | 3 min. | Nothing | 2.4 |
| | 20 | 106 | 1 min. 45 sec. | 3 min. | Nothing | 2.3 |
| | 21 | 107 | 1 min. 45 sec. | 3 min. | Nothing | 2.4 |
| | 22 | 108 | 1 min. 45 sec. | 3 min. | Nothing | 2.3 |
| | 23 | 109 | 1 min. 45 sec. | 3 min. | Nothing | 2.3 |
| | 24 | 110 | 1 min. 45 sec. | 3 min. | Nothing | 2.2 |
| | 25 | 105 | 1 min. 45 sec. | 2 min. 30 sec. | Nothing | 4.0 |
| | 26 | 106 | 1 min. 30 sec. | 2 min. 30 sec. | Nothing | 3.4 |
| | 27 | 107 | 1 min. 30 sec. | 2 min. 30 sec. | Nothing | 4.2 |
| | 28 | 108 | 1 min. 30 sec. | 2 min. 30 sec. | Nothing | 2.2 |
| | 29 | 109 | 1 min. 30 sec. | 2 min. 30 sec. | Nothing | 2.3 |
| | 30 | 110 | 1 min. 30 sec. | 2 min. 30 sec. | Nothing | 2.2 |

As a result, it was found that the samples 1–4 and 13–18, which did not use the desilverizing step of the invention, give considerably high amount of residual silver. As regards, the film samples which used the desilverizing step of the invention but did not use the coupler of the invention, it was found that the amount of residual silver of the samples did not reach a practical low level (about 5 $\mu g/cm^2$) even when the total time of the bleaching step and the bleaching-and-fixing step was extended (compare the samples 9–12 with the samples 5–8).

In contrast, as regards the samples which used both the film samples of the invention and the desilverizing step of the invention, it was found that the amount of the residual silver reaches to a low level presenting no problems in practical use.

Furthermore, it was found that the samples using the polymer coupler had very good desilverizing ability (see film examples 108–110).

EXAMPLE 2

Silver halide color photosensitive materials were processed by the same method as set forth in Example 1, except that the following bleaching accelerator A or B was added to the bleaching solution in such amount that the content of the bleaching accelerator is $5\times10^{-3}$ mol/l.

Bleaching accelerator A:

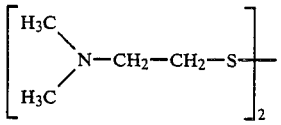

Bleaching accelerator B:

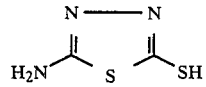

In this connection, the accelerators A and B have the above-described formula [IV] and [V] respectively. The results obtained are shown in Table 2.

TABLE 2

| | Sample No. | Bleaching Accelerator | Film Sample No. | Desilverization Process Time: Bleaching | Bleaching-and-Fixing | Fixing | Residual Silver ($\mu g/cm^2$) |
|---|---|---|---|---|---|---|---|
| Comparison Sample | 1 | A | 101 | 40 sec. | Nothing | 3 min. | 24.5 |
| | 2 | " | 102 | " | " | " | 24.3 |
| | 3 | " | 103 | " | " | " | 24.9 |
| | 4 | " | 104 | " | " | " | 25.1 |
| | 5 | " | 105 | " | " | " | 24.6 |
| | 6 | " | 106 | " | " | " | 24.2 |
| | 7 | " | 107 | " | " | " | 25.0 |
| | 8 | " | 108 | " | " | " | 24.5 |
| | 9 | " | 109 | " | " | " | 23.9 |
| | 10 | " | 110 | " | " | " | 25.3 |
| | 11 | " | 101 | " | 3 min. | Nothing | 7.3 |
| | 12 | " | 102 | " | " | " | 7.5 |
| | 13 | " | 103 | " | " | " | 6.9 |
| | 14 | " | 104 | " | " | " | 7.2 |
| | 15 | B | 101 | " | Nothing | 3 min. | 25.3 |
| | 16 | " | 102 | " | " | " | 26.1 |
| | 17 | " | 103 | " | " | " | 25.5 |
| | 18 | " | 104 | " | " | " | 25.8 |
| | 19 | " | 105 | " | " | " | 25.4 |
| | 20 | " | 106 | 40 sec. | Nothing | 3 min. | 25.0 |
| | 21 | " | 107 | " | " | " | 25.9 |
| | 22 | " | 108 | " | " | " | 26.1 |
| | 23 | " | 109 | " | " | " | 25.8 |
| | 24 | " | 110 | " | " | " | 26.3 |
| | 25 | " | 101 | " | 3 min. | Nothing | 8.2 |
| | 26 | " | 102 | " | " | " | 8.5 |
| | 27 | " | 103 | " | " | " | 8.4 |
| | 28 | " | 104 | " | " | " | 8.9 |
| Invention Sample | 29 | A | 105 | " | 3 min. | " | 2.9 |
| | 30 | " | 106 | " | " | " | 2.7 |

TABLE 2-continued

| Sample No. | Bleaching Accelerator | Film Sample No. | Desilverization Process Time: Bleaching | Bleaching-and-Fixing | Fixing | Residual Silver ($\mu g/cm^2$) |
|---|---|---|---|---|---|---|
| 31 | " | 107 | " | " | " | 2.6 |
| 32 | " | 108 | " | " | " | 2.1 |
| 33 | " | 109 | " | " | " | 1.9 |
| 34 | " | 110 | " | " | " | 2.0 |
| 35 | B | 105 | " | " | " | 3.9 |
| 36 | " | 106 | " | " | " | 3.6 |
| 37 | " | 107 | " | " | " | 3.7 |
| 38 | " | 108 | " | " | " | 3.3 |
| 39 | " | 109 | " | " | " | 3.2 |
| 40 | " | 110 | " | " | " | 3.4 |

As is obvious from Table 2, all residual silver amounts of samples 1 to 10 and 15 to 24 without employing the desilverizing step of the invention are more than 20 $\mu g/cm^2$, so that the desilverizing effects are bad.

In contrast, the desilverizing effect can be increased by the desilverizing step of the invention, whereas the residual silver amounts of samples 11 to 14 and 25 to 28 without employing such step do not reach a practical low level (about 5 $\mu g/cm^2$). However, when the desilverizing step of the invention is applied to the film samples containing the coupler specified in the invention, silver contained in the films are desilverized to not more than 5 $\mu g/cm^2$, referring to samples 29 to 40 of Table 2. In addition, bleaching time can be shortened by using the bleaching accelerators.

EXAMPLE 3

Silver halide color photosensitive materials Nos. 101–110 prepared in Example 1 were processed by the same method as set forth in Example 1, except that one or the other of the following methods A and B was used

| Steps | Temp. | Method A | Method B |
|---|---|---|---|
| Color development | 38° C. | 3 min. 15 sec. | 3 min. 15 sec. |
| Bleaching | 38° C. | 1 min. 30 sec. | — |
| Bleaching-and-fixing | 38° C. | 2 min. 30 sec. | 4 min. |
| Washing | 30° C. | 3 min. 15 sec. | 3 min. 15 sec. |
| Stabilizing | 38° C. | 1 min. 5 sec. | 1 min. 5 sec. |

The amount of residual silver of the thus processed photosensitive materials was measured by the same method as set forth in Example 1. The results obtained are shown in Table 3.

TABLE 3

| | Film sample No. | Kind of coupler | Method | Residual silver ($\mu g/cm^2$) |
|---|---|---|---|---|
| Comparative example | 101 | 4 equivalent | B | 42.1 |
| | 102 | " | " | 40.0 |
| | 103 | " | " | 37.6 |
| | 104 | " | " | 38.2 |
| | 101 | " | A | 10.0 |
| | 102 | " | " | 10.8 |
| | 103 | " | " | 9.8 |
| | 104 | " | " | 10.6 |
| | 105 | 2 equivalent | B | 25.5 |
| | 106 | " | " | 27.3 |
| | 107 | " | " | 24.6 |
| | 108 | " | " | 20.5 |
| | 109 | " | " | 19.8 |
| | 110 | " | " | 21.0 |
| Present invention | 105 | 2 equivalent | A | 4.0 |
| | 106 | " | " | 3.4 |
| | 107 | " | " | 4.2 |
| | 108 | " | " | 2.2 |
| | 109 | " | " | 2.3 |
| | 110 | " | " | 2.2 |

As is clear from Table 3, the amount of residual silver can be greatly reduced by a combination of bleaching step and bleaching-and-fixing step according to the present invention, as compared with the use of only a bleaching step in the comparative example.

What is claimed is:

1. A processing method for silver halide color photosensitive materials comprising the steps of:

color developing an exposed silver halide color photosensitive material containing 5-pyrazolone-type or pyrazoloazole-type 2-equivalent magenta coupler and silver halide in an amount of 2 to 12 g as Ag per $m^2$ of the photosensitive material, said silver halide containing silver iodide; and desilvering said photosensitive material by a desilverizing step using bleaching bath containing ferric complex salt aminopolycarboxylate, and thereafter using a bleaching-and-fixing bath containing ferric complex salt aminopolycarboxylate.

2. A processing method as set forth in claim 1, wherein 5-pyrazolone-type magenta coupler has the following formula:

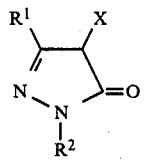

[I]

wherein $R^1$ represents a carbonamido group, an anilino group, a sulfonamido group, or a ureido group; $R^2$ represents a phenyl group; and X represents a group capable of being eliminated as an anion by the coupling reaction with the oxidized product of an aromatic primary amine developing agent.

3. A processing method as set forth in claim 1, wherein pyrazoloazole type 2-equivalent magenta coupler has the following formula:

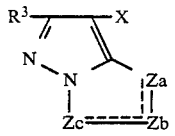

[II]

wherein $R^3$ represents a hydrogen atom or a substituent; X represents a group capable of being eliminated as an anion by the coupling reaction with the oxidized product of an aromatic primary amine developing agent; Za, Zb, and Zc each represents methine, substituted methine, and =N—or —N—, one of the Za-Zb bond and the Zb-Zc bond being a double bond and the other being a single bond.

4. A processing method as set forth in claim 1, wherein pyrazoloazol type 2-equivalent magenta coupler is selected from compounds having one of the following formulas (II-1) to (II-7):

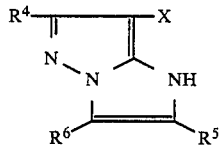

(II-1)

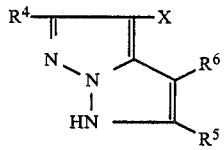

(II-2)

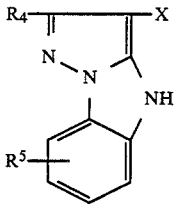

(II-3)

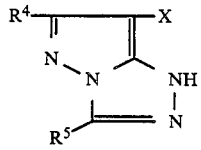

(II-4)

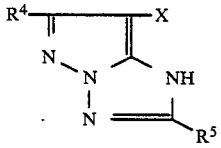

(II-5)

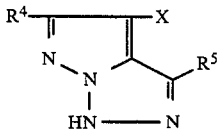

(II-6)

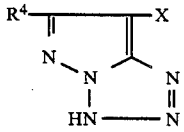

(II-7)

$R^4$, $R^5$, and $R^6$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; and X represents a hydrogen atom; and halogen atom, a carboxy group; or a group capable of being coupling eliminated, the group being connected to the carbon atom at the coupling site through an oxygen atom, a nitrogen atom, or a sulfur atom, each of $R^4$, $R^5$, $R^6$ and X enabling divalent groups to form bis-compounds.

5. A processing method is set forth in claim 4, wherein the magenta coupler has one of said formula (II-1), (II-4) and (II-5).

6. A processing method as set forth in claim 4, wherein the magenta coupler has said formula (II-5).

7. A processing method as set forth in claim 1, wherein a remaining group of both the magenta coupler consists of a polymer having the following recurring unit (Cp-1) or (Cp-2):

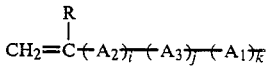

(Cp-1)

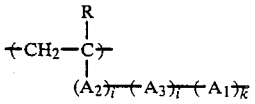

(Cp-2)

wherein R represents a hydrogen atom, a lower alkyl group containing one to four carbon atoms, or a chlorine atom; $A_1$ represents —$CONR^7$—, —$NR^7CONR^7$—, —$NR^7COO$—, —COO—, —$SO_2$—, —CO—, —$NR^7CO$—, —$SO_2NR^7$—, —$NR^7SO_2$—, —OCO—, —$OCONR^7$—, —$NR^7$—, or —O—; $A_2$ represents —$CONR^7$— or —COO—; $R^7$ represents a hydrogen atom, an aliphatic group, or an aryl group; $A_3$ represents an unsubstituted or substituted alkylene group containing one to ten carbon atoms, an aralkylene group; or an unsubstituted to substituted arylene group: and i, j, and k represent 0 or 1.

8. A processing method as set forth in claim 1, wherein ferric complex salt aminopolycarboxylate is contained in an amount of 0.1 to 1 mol per liter in the bleaching bath and in an amount of 0.05 to 0.5 mol per liter in bleaching-and-fixing bath.

9. A processing method as set forth in claim 1, wherein the aminopolycarboxylate is at least one complex of ferric ions and aminocarboxylic acid or its salts selected from the group consisting of ethylenediaminetetraacetic acid, disodium ethylenediaminetetraacetate, diammonium ethylenediaminetetraacetate, diethylenetriaminepentaacetic acid, 1,3-Propylenediaminetetraacetic acid, Disodium 1,3-Propylenediaminetetraacetate, cyclohexanediaminetetraacetic acid, disodium cyclohexanediaminetetraacetate and iminodiacetic acid.

10. A processing method as set forth in claim 1, wherein the bleaching bath contains a bleaching accelerator in an amount of $1\times10^{-4}$ to $5\times10^{-2}$ mol.

11. A processing method as set forth in claim 10, wherein the bleaching accelerator is selected from the group consisting of a compound having a mercapto group or disulfide bond, thiazolidine derivatives and isothiourea derivatives.

12. A processing method as set forth in claim 10, wherein the bleaching accelerator is at least one compound having one of the following formulas (III) to (IX):

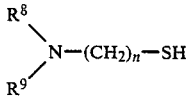

[III]

-continued

[IV]

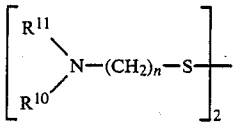

[V]

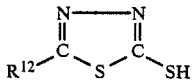

[VI]

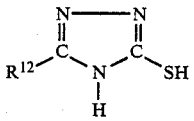

[VII]

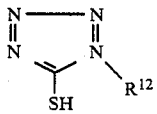

[VIII]

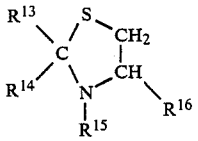

[IX]

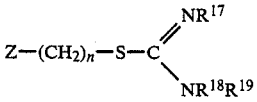

wherein $R^8$, $R^9$, $R^{10}$ and $R^{11}$ each represents a hydrogen atom, a substituted or unsubstituted lower alkyl group or an acyl group; $R^{12}$ represents a hydrogen atom, a halogen atom, an amino group, a substituted or unsubstituted lower alkyl group to or an amino group containing alkyl groups, $R^{13}$ and $R^{14}$ each represents a hydrogen atom, substituted or unsubstituted alkyl group, substituted or unsubstituted phenyl group, substituted or unsubstituted heterocyclic group; $R^{15}$ represents a hydrogen atom or substituted or unsubstituted lower alkyl group, $R^{16}$ represents a hydrogen atom or a carboxyl group; $R^{17}$, $R^{18}$ and $R^{19}$ each represents a hydrogen atom or a lower alkyl group; n represent 1 to 3; and Z represents an amino group, a sulfo group, or a carboxyl group.

13. A processing method as set forth in claim 12, wherein the bleaching accelerator has one of said formulas (IV) to (VI).

14. A processing method as set forth in claim 1, wherein the bleaching time is between 20 seconds and 4 minutes.

15. A processing method as set forth in claim 1, wherein the bleaching-and-fixing time is between 1 and 5 minutes.

16. A processing method as set forth in claim 1, wherein said silver halide contains silver iodide at 2 to 25 mol%.

17. A processing method as set forth in claim 1, wherein said silver halide contains silver iodide at 4 to 20 mol%.

18. A processing method as set forth in claim 1, wherein the photosensitive material contains silver halide in an amount of 3 to 10 g as Ag per $m^2$ of the photosensitive material.

* * * * *